US007296390B2

(12) United States Patent
Koke et al.

(10) Patent No.: US 7,296,390 B2
(45) Date of Patent: Nov. 20, 2007

(54) VACUUM PACKAGING MACHINE HAVING A PLURALITY OF VACUUM CHAMBERS FOR PERFORMING A VACUUM SEALING OPERATION ON PRODUCT PACKAGES

(75) Inventors: John Koke, Duncan, SC (US); Jacob Brinkman, Hamilton (NZ); Ron Whitehead, Hamilton (NZ); David Stevens, Port Melbourne (AU)

(73) Assignee: Sealed Air New Zealand, Hamilton (NZ)

( * ) Notice: Subject to any disclaimer, the term of this patent is extended or adjusted under 35 U.S.C. 154(b) by 112 days.

(21) Appl. No.: 10/504,506

(22) PCT Filed: Feb. 27, 2003

(86) PCT No.: PCT/NZ03/00034

§ 371 (c)(1),
(2), (4) Date: Mar. 23, 2005

(87) PCT Pub. No.: WO03/072438

PCT Pub. Date: Sep. 4, 2003

(65) Prior Publication Data

US 2005/0178090 A1 Aug. 18, 2005

(30) Foreign Application Priority Data

Feb. 27, 2002 (NZ) ..... 517488
Dec. 20, 2002 (NZ) ..... 523298
Jan. 21, 2003 (NZ) ..... 523718

(51) Int. Cl.
*B65B 31/02* (2006.01)

(52) U.S. Cl. ..... 53/510; 53/202

(58) Field of Classification Search ..... 53/432–434, 53/510–512, 202
See application file for complete search history.

(56) References Cited

U.S. PATENT DOCUMENTS 3,580,141 A 5/1971 Richter
3,816,969 A 6/1974 Zimmerman et al.
3,850,755 A 11/1974 Welty
3,958,391 A 5/1976 Kujubu
3,990,214 A 11/1976 Bell et al.
4,471,599 A 9/1984 Mugnai (Continued)

FOREIGN PATENT DOCUMENTS

DE 43 10 376 A1 10/1993

(Continued)

*Primary Examiner*—Stephen F. Gerrity
(74) *Attorney, Agent, or Firm*—Mark B. Quatt

(57) ABSTRACT

A vacuum packaging machine includes a plurality of vacuum chambers (3*a*, 3*b*) each arranged to receive at least one unsealed product package and operable to perform an independent vacuum sealing operation, each vacuum chamber having a longitudinal direction defined by a direction of travel of the respective product package through the chamber (3*a*, 3*b*), each chamber having a heat seal assembly (15) therein which extends transversely to the longitudinal direction. An infeed conveyor (17) can be provided with a telescoping portion (17*a*) which can extend over the heat seal assembly or a part thereof. Each vacuum chamber can have a respective bed (9) and independently moveable hood (11), and the beds (9) can be synchronously vertically moveable. The vacuum packaging machine can be used in combination with a suitable product bagging or wrapping machine.

11 Claims, 22 Drawing Sheets

U.S. PATENT DOCUMENTS

| | | | | | |
|---|---|---|---|---|---|
| 4,550,548 | A | | 11/1985 | Owensby et al. | |
| 4,580,393 | A | * | 4/1986 | Furukawa | 53/512 |
| 4,791,775 | A | | 12/1988 | Raque et al. | |
| 4,813,526 | A | | 3/1989 | Bélanger | |
| 4,843,796 | A | * | 7/1989 | Furukawa | 53/434 |
| 4,869,050 | A | | 9/1989 | Furukawa | |
| 5,044,142 | A | | 9/1991 | Gianelli | |
| 5,062,252 | A | | 11/1991 | Kupcikevicius | |
| 5,088,268 | A | | 2/1992 | Gunter | |
| 5,155,969 | A | | 10/1992 | Kuethe | |
| 5,376,394 | A | * | 12/1994 | Dudenhoeffer et al. | 426/415 |
| 5,692,360 | A | * | 12/1997 | McDonald et al. | 53/434 |
| 5,692,593 | A | | 12/1997 | Ueno et al. | |
| 6,105,751 | A | | 8/2000 | Jentjens et al. | |
| 6,227,377 | B1 | | 5/2001 | Bonnet | |
| 6,499,274 | B1 | * | 12/2002 | McDonald et al. | 53/434 |
| 6,539,689 | B1 | * | 4/2003 | Yoshimoto | 53/434 |

FOREIGN PATENT DOCUMENTS

| | | | |
|---|---|---|---|
| EP | 0 836 996 A1 | | 4/1998 |
| IT | 1316893 | | 2/2000 |
| WO | 90/07452 | | 7/1990 |
| WO | 96/11844 | | 4/1996 |
| WO | 98/12111 | | 3/1998 |
| WO | 00/27706 | | 5/2000 |
| WO | WO 2001/08979 | * | 2/2001 |
| WO | 01/56888 | | 8/2001 |
| WO | 02/10019 | | 2/2002 |

* cited by examiner

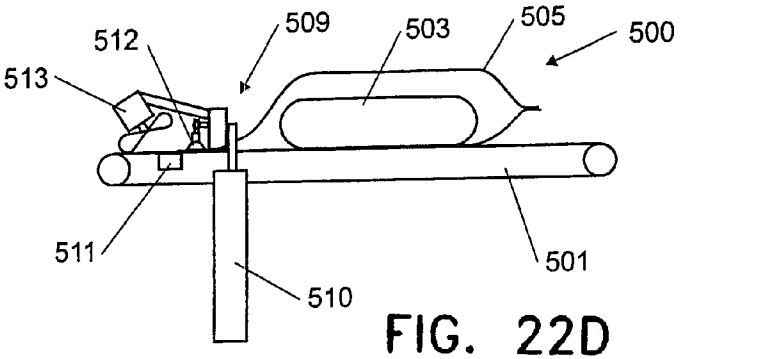
FIG. 22A
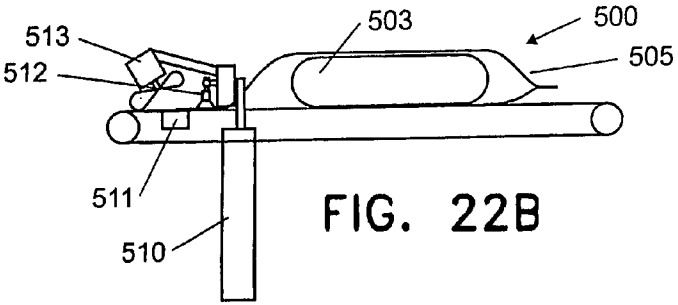
FIG. 22B
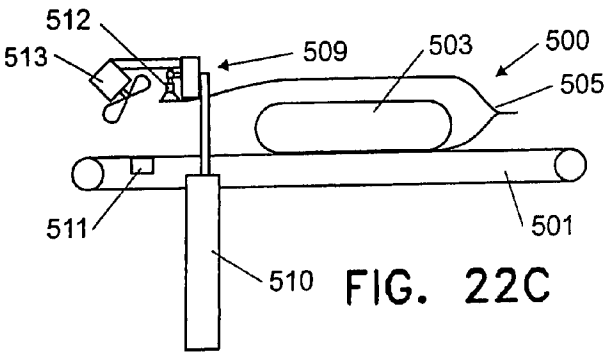
FIG. 22C
FIG. 22D
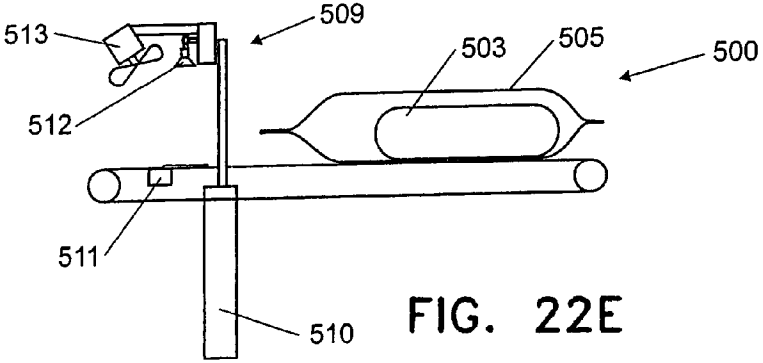
FIG. 22E

VACUUM PACKAGING MACHINE HAVING A PLURALITY OF VACUUM CHAMBERS FOR PERFORMING A VACUUM SEALING OPERATION ON PRODUCT PACKAGES

The present application is a 35 USC § 371 application of PCT/NZ03/00034 filed Feb. 27, 2003, which claims the benefit of New Zealand Patent Application No. 517488 filed Feb. 27, 2002, New Zealand Patent Application No. 523298 filed Dec. 20, 2002, and New Zealand Patent Application No. 523718 filed Jan. 21, 2003.

FIELD OF THE INVENTION

The present invention relates to a vacuum packaging machine for performing a vacuum sealing operation on product packages.

BACKGROUND OF THE INVENTION

Vacuum packaging machines of a known type include a vacuum chamber arranged to receive unsealed product packages and operable to perform a vacuum sealing operation on the product packages. Typically the product packages contain products such as meat cuts, arranged in a bag formed by a heat-shrinkable film. After loading and closing the vacuum chamber, the vacuum sealing operation typically includes vacuumization, sealing the mouth of the vacuumized bags, and reintroducing air into the chamber. The chamber is then opened and the vacuum chamber is unloaded. In some applications, the packages may then be conveyed to a heat-shrinking unit, typically a hot water tunnel or a dip tank, to shrink the packaging around the product.

In conventional conveyorised chamber systems, the vacuumization step typically takes at least 20 to 30 seconds which is significant processing time in the overall packaging process. During this time, the only step which can be taken is to prepare the next product packages for loading into the vacuum chamber, for example by conveying them onto an infeed conveyor. Accordingly, the vacuum packaging machine may cause a bottle-neck in the overall packaging process.

Rotary vacuum packaging machines are known, which include a series of vacuum chambers and chain driven product platens. In operation of the machine the platens move from a loading position, thorough a vacuum/sealing/venting stage, to an unloading position, and finally back to the loading position. One disadvantage of these machines is that they have a large footprint, on the order of about 17 $m^2$, and therefore take up a large amount of floor space. A further problem is that these machines generally require manual loading and bag spreading and are thus difficult to incorporate in a fully automated process. In addition, by its very nature the rotary system is not an in-line process. Typically, product is loaded in-line, but unloaded at a right angle to the infeed direction. This often disrupts a "streamlined" product flow through the packing area.

SUMMARY OF THE INVENTION

In a first aspect, a vacuum packaging machine comprises a plurality of vacuum chambers each arranged to receive an unsealed product package and operable to perform a vacuum sealing operation on the respective unsealed product package, each vacuum chamber having a longitudinal direction defined by a direction of travel of the respective product package through the chamber, each vacuum chamber having therein a heat seal assembly for forming a heat seal across the respective product package, the heat seal disposed transversely to said longitudinal direction.

In a second aspect, a method of vacuum sealing a product package comprises providing a vacuum packaging machine having a plurality of vacuum chambers, each of the vacuum chambers being arranged to receive an unsealed product package and operable to perform a vacuum sealing operation on the product package, each vacuum chamber having a longitudinal direction defined by a path of travel of the respective product package through the chamber, each vacuum chamber having a heat seal assembly for forming a heat seal across a respective product package, the heat seal disposed transversely to said longitudinal direction; loading an unsealed product package into one of the vacuum chambers, such that the unsealed portion of the product package is located over a portion of the heat seal assembly; and simultaneously with the loading operation, performing a vacuum sealing operation on a product package in another one of the vacuum chambers.

BRIEF DESCRIPTION OF THE DRAWINGS

Embodiments of the present invention will now be described with reference to the accompanying figures, in which:

FIGS. 22A, 22B, 22C, 22D, and 22E schematically show an embodiment of a sealing apparatus which may be used in conjunction with a vacuum packaging machine of the embodiments of FIGS. 1 to 16.

DETAILED DESCRIPTION OF THE INVENTION

Figure 1:
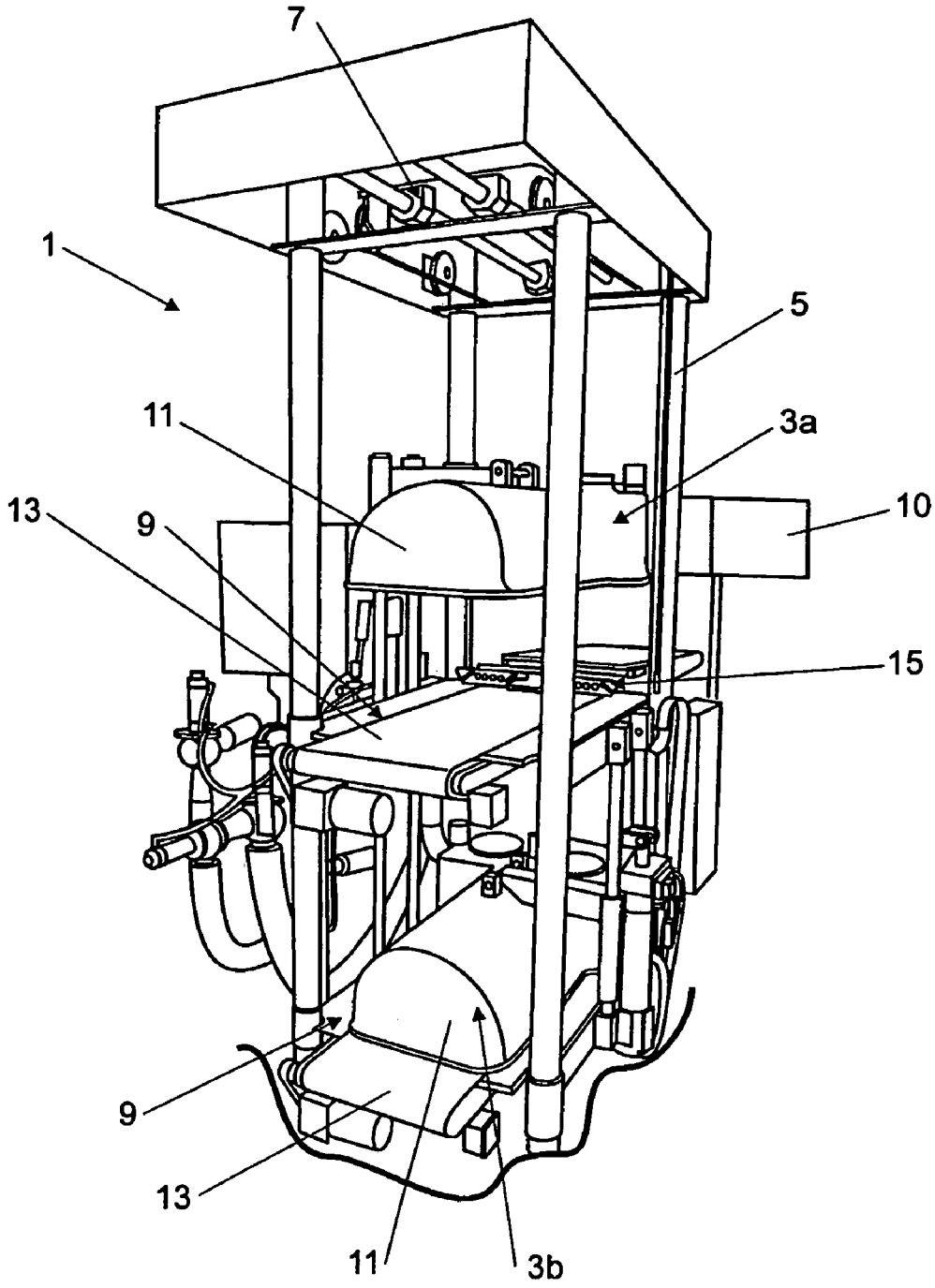
FIG. 1 is an end view of a vacuum packaging machine in accordance with one embodiment of the present invention.

The terminology "unsealed" is intended to include temporarily sealed. A temporary seal is one which is not intended to be a final package seal, and is not formed as part of the vacuum sealing operation within the vacuum packaging machine.

"One product package" or "a product package" herein includes "at least one product package", in that in some embodiments more than one product package can be introduced into a given vacuum chamber.

Having a transverse heat seal assembly in each vacuum chamber enables the product packages to be loaded into each chamber with their openings transverse to the longitudinal direction. This orientation corresponds to the orientation of the packages as they exit most manual bagging stations or automatic packaging systems, which would generally be upstream of the vacuum packaging machine.

The heat seal assembly in each vacuum chamber can include a heat seal bar. Additionally, each heat seal assembly may include a heat seal anvil.

The machine may include vacuum chambers which are arranged generally vertically one above each other. The machine may include vacuum chambers which are arranged generally horizontally one adjacent each other. The vacuum chambers may be arranged in a three-dimensional array.

The machine can be configured to operate one of the vacuum chambers to perform the vacuum sealing operation while another of the vacuum chambers is open for loading and unloading of product package(s).

The vacuum packaging machine may include or be in combination with a conveyor arrangement configured to load and/or unload product packages to and/or from the vacuum chambers.

The conveyor arrangement suitably includes at least one infeed conveyor operable to load a selected vacuum chamber with the at least one product package. The heat seal assembly in each vacuum chamber can be located at or adjacent the end of the chamber adjacent the infeed conveyor(s), and the infeed conveyor(s) is/are configured to load the product package(s) into the chamber with the unsealed portion(s) of the package(s) trailing. The infeed conveyor(s) may have a telescoping portion which is operable to telescope over the heat seal assembly or a part of the heat seal assembly in a vacuum chamber to load the product package(s) into the vacuum chamber such that an unsealed portion of the product package(s) is located over the heat seal assembly or part thereof, and to then retract from the chamber to allow the chamber to close to perform the vacuum sealing operation.

The infeed conveyor(s) can be moveable relative to the vacuum chambers to enable selective loading of more than one chamber. Alternatively, the vacuum chambers may be moveable relative to the infeed conveyor(s) to enable selective loading of more than one chamber.

Each vacuum chamber can include an internal conveyor, which is moveable in the longitudinal direction of the vacuum chamber to expel the product package(s) from the vacuum chamber following a vacuum sealing operation. A portion of the internal conveyor may extend under the heat seal assembly or a part of the heat seal assembly in each vacuum chamber. The vacuum chambers can each include a vacuum chamber hood and wherein a portion of the internal conveyor in each vacuum chamber extends under the vacuum chamber hood thereof, and wherein the internal conveyor includes a belt having a smooth underside so that the vacuum chamber hood seals over the belt.

The heat seal assembly or a part thereof may be retractable to enable products to be moved past the heat seal assembly on the internal conveyor, and the telescoping conveyor may be substantially vertically aligned with the internal chamber conveyor in a product package loading configuration. This eliminates any substantial product "drop" over the sealing assembly. It will be clear to those skilled in the art that other product loading/conveying systems would also be applicable to the machine.

The conveyor arrangement can include at least one outfeed conveyor operable to unload the product package(s) from a selected vacuum chamber. The outfeed conveyor(s) may be moveable relative to the vacuum chambers to enable selective unloading of more than one chamber. Alternatively, the vacuum chambers may be moveable relative to the outfeed conveyor(s) to enable selective unloading of more than one chamber.

The conveyor arrangement can be operable to substantially simultaneously load an unsealed product package into a selected vacuum chamber and unload another recently-sealed product package from the selected vacuum chamber.

The machine can include two vertically-stacked vacuum chambers, an infeed conveyor and an outfeed conveyor, the vacuum chambers being synchronously vertically moveable between a loading/unloading position adjacent and between the infeed and outfeed conveyor and an operating position spaced from the infeed and outfeed conveyor, the machine being operable such that as one vacuum chamber is performing the vacuum sealing operation, the other vacuum chamber is open for loading/unloading.

The vacuum packaging machine may be arranged to load a single product package into a selected vacuum chamber at a time for the vacuum sealing operation.

The vacuum packaging machine may be arranged to concurrently load more than one product package into a selected vacuum chamber at a time for the vacuum sealing operation to be vacuum sealed concurrently, in a transverse orientation of the packages relative to the longitudinal direction of the machine.

The machine can further include a puncturing device which is operable to puncture at least one aperture in the product package(s) adjacent the heat seal assembly, so that as each vacuum sealing operation occurs, air is forced out of the package through the punctured aperture(s) prior to heat sealing. The puncturing device may comprise a plurality of piercing knives.

The machine can further include a cutting device which is operable to cut the product package(s) between the heat seal bar or heat seal anvil and the puncturing device following vacuum sealing operations.

The machine may include a scrap removal device to remove cut-off portions of the product package(s) from the machine following vacuum sealing operations. The scrap removal device can be configured to form an air jet or curtain to blow the cut-off portions towards a suction device.

The machine suitably includes a cross-flow valve mechanism which is arranged to transfer pressure from a recently-loaded vacuum chamber to a recently-evacuated vacuum chamber. The cross-flow valve mechanism can be arranged to transfer about one half atmosphere pressure from the recently-loaded vacuum chamber to the recently-evacuated vacuum chamber.

In the embodiment including vertically-moveable vacuum chambers, each vacuum chamber may include a bed and a hood which is independently moveable relative to the bed, the beds being moveable simultaneously such that the vertical spacing between the vacuum chambers is maintained.

The machine can include a mechanism to provide synchronous vertical movement of the beds of the vacuum chambers.

The machine can include at least one constant pressure pneumatic cylinder to counterbalance the weight of the vacuum chambers.

The machine can include a framework having a main frame part and a sub-frame part which is vertically moveable relative to the main frame part, the vacuum chamber beds being fixed relative to the sub-frame part such that vertical movement of the sub-frame part results in synchronous vertical movement of the vacuum chamber beds. The framework may comprise a pressure vessel for the constant pressure pneumatic cylinder.

The machine can include a crank arrangement arranged to vertically move the vacuum chambers.

The machine may include a spreading system for spreading the unsealed part of the product package prior to sealing. The spreading system can include upper and lower pairs of complementary spreader bars which are configured to move apart as they are brought towards each other, thereby gripping and spreading the product package.

A transverse heat seal assembly may be located in a longitudinal position in each vacuum chamber such that there is sufficient spacing between end walls of the vacuum chamber and each heat seal assembly for a product package containing two products to be loaded into the vacuum chamber with one product located in front of the heat seal assembly and the other product located behind the heat seal assembly, the heat seal assembly arranged to seal and cut across the product package between two products to form two separate evacuated packages. The heat seal assembly is preferably located centrally in the longitudinal direction within each vacuum chamber. The heat seal assembly can include two heat seal bars or a double heat seal bar which extend(s) across the interior of the vacuum chamber, and a cutting device operates between the two heat seal bars or double heat seal bar.

The vacuum packaging machine may be in combination with a sealing mechanism to form a temporary or presentation seal on part of the product package(s) prior to loading into the vacuum packaging machine to assist in positioning that part of the product package(s) in relation to the heat seal assembly during loading of the product packages into the vacuum packaging machine, maintain that part of the product package(s) under some tension, the vacuum packaging machine configured to evacuate the product package(s) and form a final seal in the product package(s), optionally between the presentation seal and the product(s). Alternatively, the final seal may be formed in the same position as the presentation seal.

The sealing mechanism can be configured to form a temporary or presentation seal on one part of each product package and a separate permanent or final seal on another part of each product package.

The sealing mechanism can include a pair of heat seal bars or a double heat seal bar and one or more anvils, with one bar or part of the double bar comprising a first sealing arrangement to form the presentation seal, and the other bar or another part of the double bar comprising a second sealing arrangement to form the final seal.

In one embodiment, the sealing mechanism includes a cutting device between the first and second seal bars or the first and second parts of the double bar for separating adjacent packages between the presentation seal and final seal.

The presentation seal may be a perforated or patterned seal.

The sealing mechanism can be configured to apply tack welds on the product package(s) to form the presentation seal(s).

In one embodiment, the sealing mechanism is configured to capture air in the product package(s) as the presentation seal(s) is/are formed, and the heat seal assembly or assemblies in the vacuum packaging machine is/are arranged to partially compress the product package(s) prior to sealing of the package(s), to substantially flatten the product package(s) against the heat seal assembly or assemblies or part(s) thereof prior to forming the final seal in each product package.

The sealing mechanism can include or be provided in combination with a fan or blower to blow gas or air into the product package prior to the formation of the presentation seal.

The sealing mechanism may be part of a wrapping or bagging machine.

In one embodiment, the vacuum packaging machine can include or is provided in combination with a conveyor arrangement configured to load and/or unload product packages to and/or from the vacuum chambers, the conveyor arrangement including at least one infeed conveyor having a telescoping portion operable to telescope over the heat seal assembly or a part of the heat seal assembly, and the loading operation includes extending the telescoping portion of the infeed conveyor in to the vacuum chamber, positioning the product package in the vacuum chamber such that the unsealed or temporarily sealed part of the product package is positioned above the heat seal assembly or a part of the heat seal assembly, and retracting the telescoping portion of the infeed conveyor from the vacuum chamber to allow the chamber to be closed.

An internal conveyor can be present in each of the vacuum chambers, and the loading operation can include substantially simultaneously expelling a recently-sealed product package from the vacuum chamber.

In one embodiment, the heat seal assembly can include a clamping device and the vacuum sealing operation includes clamping the unsealed part(s) of the product package(s) prior to evacuation and heat sealing.

The machine can include a puncturing device which is operable to puncture at least one aperture in the product package(s) adjacent the heat seal assembly, and the vacuum sealing operation can include puncturing the product package(s) prior to evacuation and heat sealing.

In one embodiment, the machine can include a cutting device arranged to cut the product package(s) between the heat seal assembly and the puncturing device, and the vacuum sealing operation can include cutting the package(s) following evacuation and heat sealing.

The method can include, following a loading operation and a vacuum sealing operation, closing the recently-loaded vacuum chamber and performing a vacuum sealing operation on the product package(s) in that chamber, and substantially simultaneously with the vacuum sealing operation in the recently-loaded vacuum chamber, opening the recently-evacuated vacuum chamber and unloading the product package(s) from the recently-evacuated vacuum chamber and substantially simultaneously loading at least one unsealed product package into the recently-evacuated vacuum chamber.

In one embodiment, the vacuum packaging machine can include a cross-flow valve mechanism, and the method can include, following the completion of a vacuum sealing operation and a loading operation and closing of the recently-loaded vacuum chamber, transferring pressure from the recently-loaded vacuum chamber to the recently-evacuated vacuum chamber.

As an example, about one half atmosphere pressure can be transferred from the recently-loaded vacuum chamber to the recently-evacuated vacuum chamber.

In one embodiment, the vacuum packaging machine can include vertically moveable vacuum chambers, each vacuum chamber including a bed and a hood which is independently moveable relative to the bed, the beds being moveable simultaneously such that the vertical spacing between the vacuum chambers is maintained, and the method can include, following a vacuum sealing operation on one vacuum chamber and a loading operation on the other vacuum chamber, moving the vacuum chambers so that the recently-evacuated vacuum chamber is in a loading position and the recently-loaded vacuum chamber is in an evacuating position.

Each vacuum chamber can include a spreading system, and the vacuum sealing operation can include spreading the unsealed part of the product package across the heat seal assembly or a part of the heat seal assembly heat prior to evacuating and heat sealing.

In one embodiment, a transverse heat seal assembly can be located in a longitudinal position in each vacuum chamber such that there is sufficient spacing between end walls of the vacuum chamber and the heat seal assembly for a product package containing two products to be loaded into the vacuum chamber, and the loading operation can include loading a product package containing two products into one of the vacuum chambers such that one product is located in front of the heat seal assembly the other product is located behind the heat seal assembly, and the vacuum sealing operation can include sealing the product package between the products and cutting across the product package between the two products to form two separate evacuated product packages.

The heat seal assembly may be located centrally in the longitudinal direction within each vacuum chamber.

The method can include prior to loading the product package(s) into a vacuum chamber, forming a temporary or presentation seal on part of the product package(s) to maintain that part of the product package(s) under some tension and/or to at least partially flatten that part of the product package(s).

In one embodiment, the permanent or final seal is formed in the product package(s) between the product(s) and the presentation or temporary seal(s).

The vacuum sealing operation can include cutting across the package(s) between the permanent or final seal(s) and the presentation or temporary seal(s).

The temporary or final seal(s) may be perforated or patterned seal(s).

The step of forming the presentation or temporary seal(s) comprises applying tack welds to the product package(s).

In one embodiment, the step of forming a temporary or presentation seal in the product package(s) can include capturing air or gas in the product package(s), and the vacuum sealing operation can include partially compressing the product package(s) between parts of the heat seal assembly in the vacuum chamber to substantially flatten the product package(s) against the parts of the heat seal assembly prior to evacuation and forming the final seal.

Figure 2:
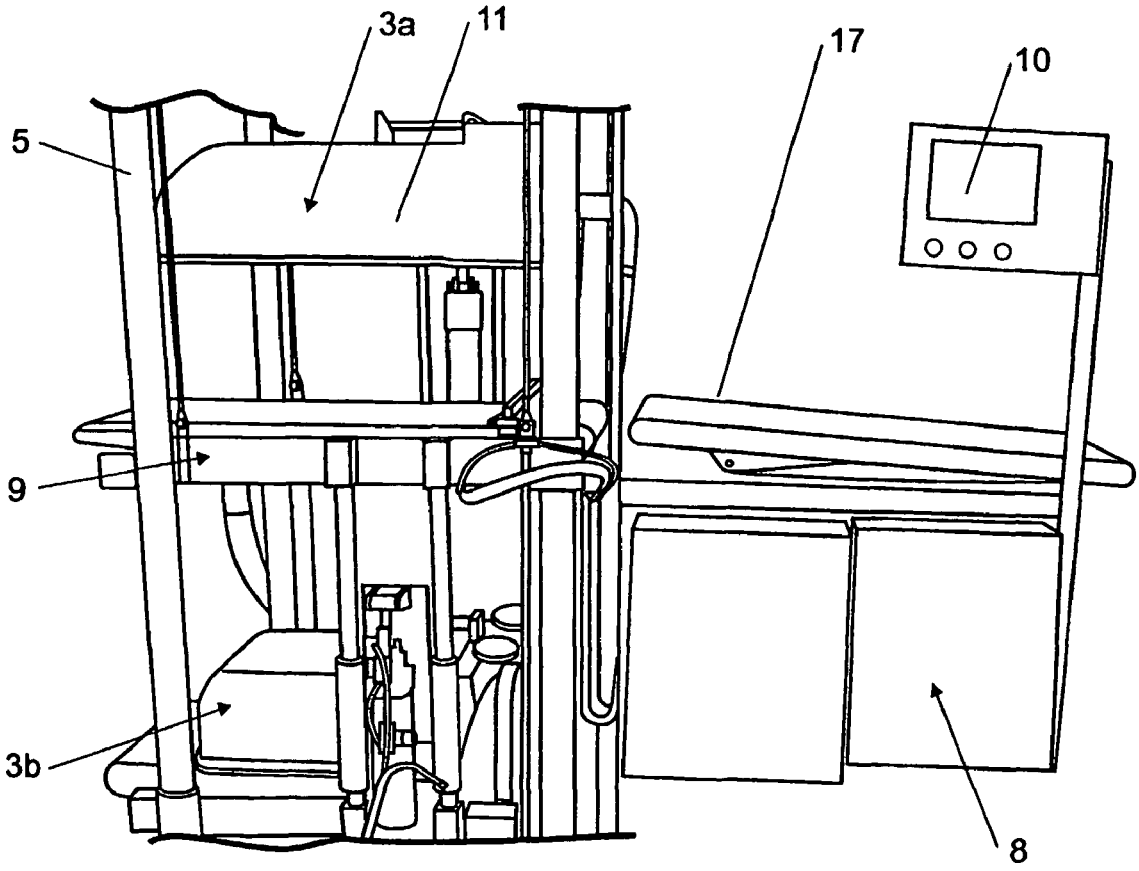
FIG. 2 is a side elevation view of the vacuum packaging machine of FIG. 1.
Figure 3:
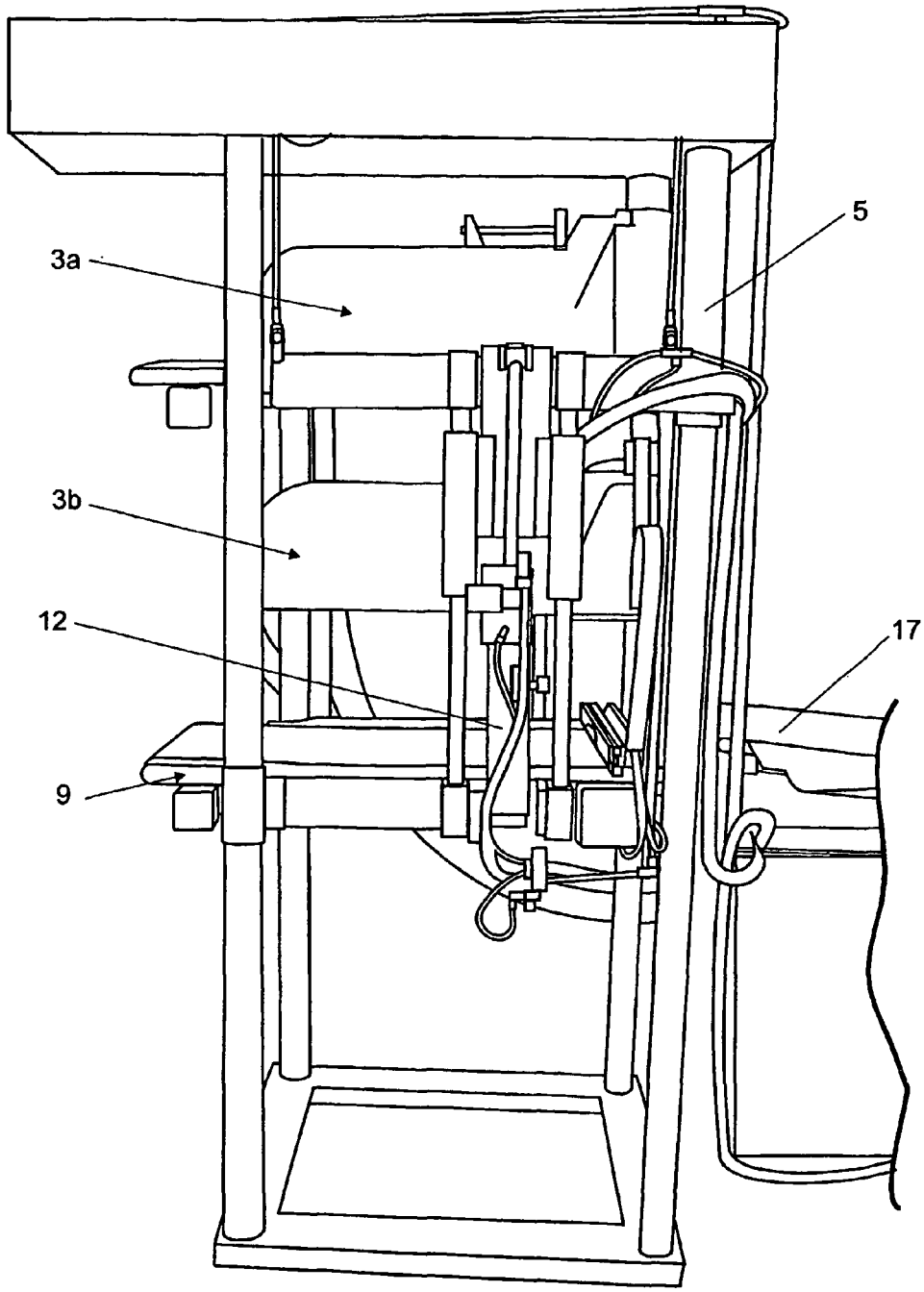
FIG. 3 is a further side elevation view of the vacuum packaging machine of FIG. 1.
Figure 4:
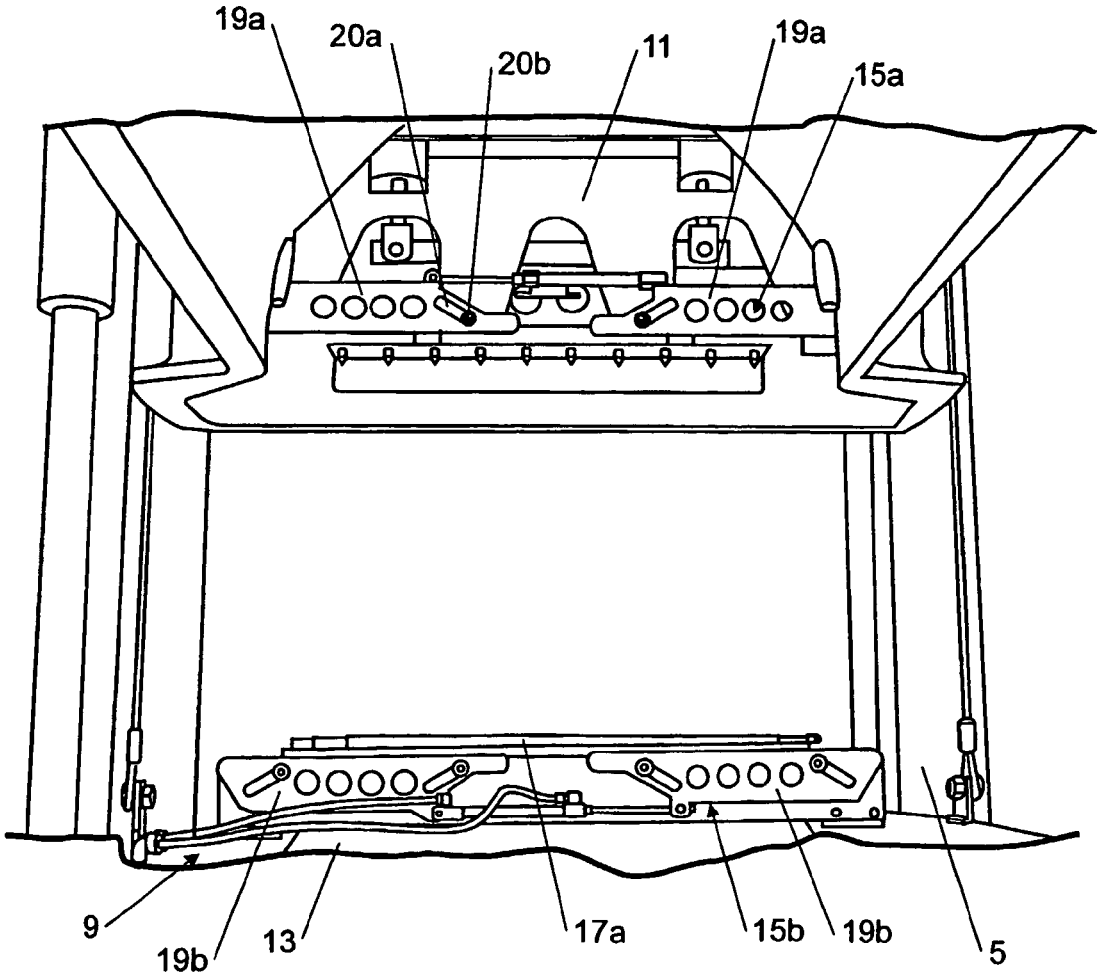
FIG. 4 is a view of the interior of a vacuum chamber, showing a sealing assembly.
Figure 5:
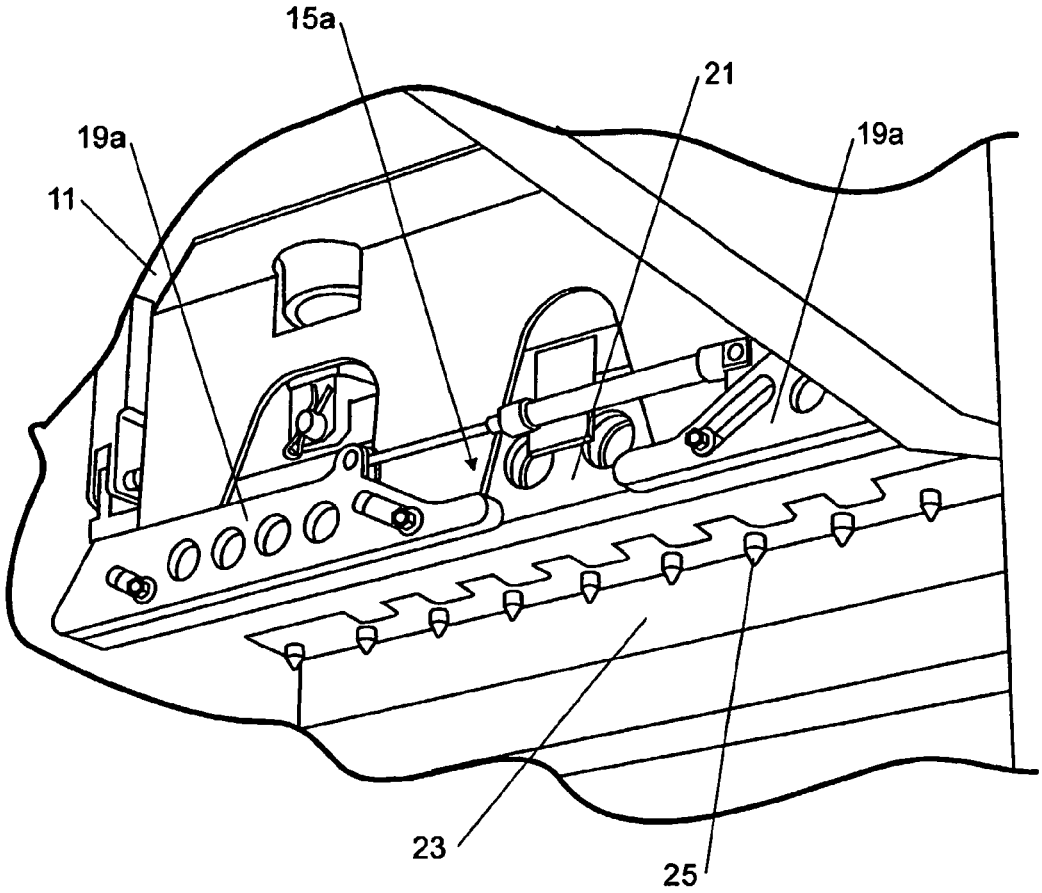
FIG. 5 is a perspective view of the upper interior of a vacuum chamber, showing the details of the upper part of the sealing assembly of FIG. 4.
Figure 6:
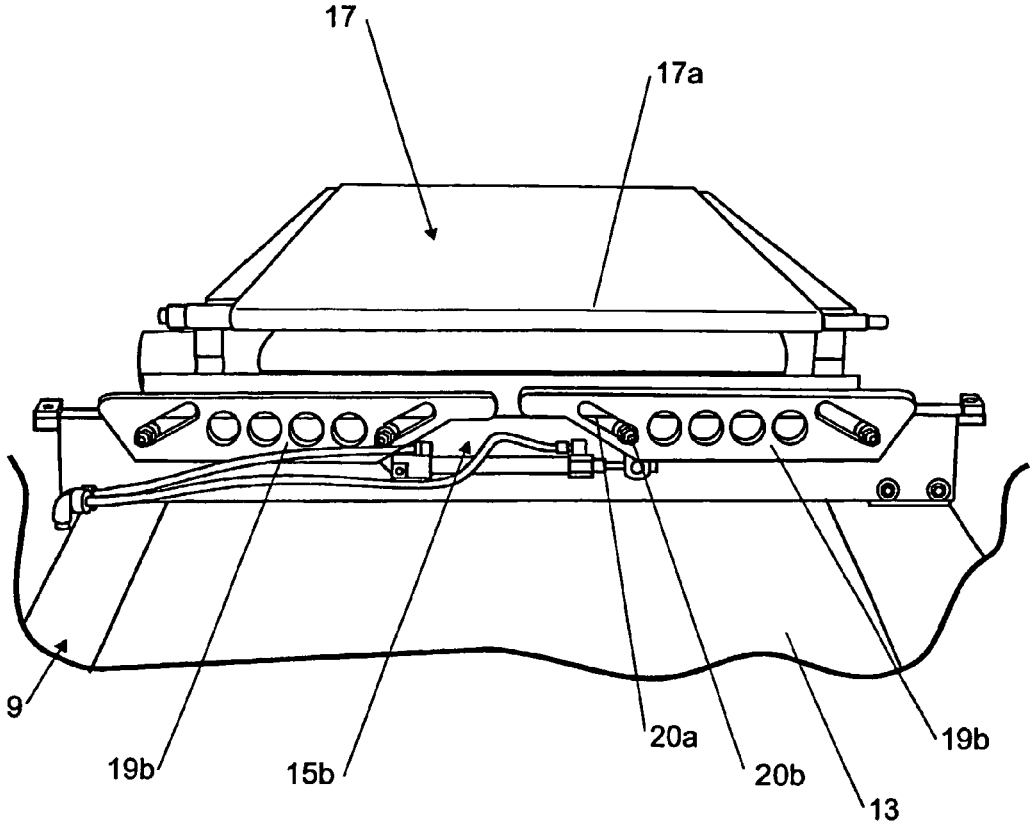
FIG. 6 is a view of the lower part of a vacuum chamber, showing details of a lower part of the sealing assembly of FIG. 4.
Figure 7:
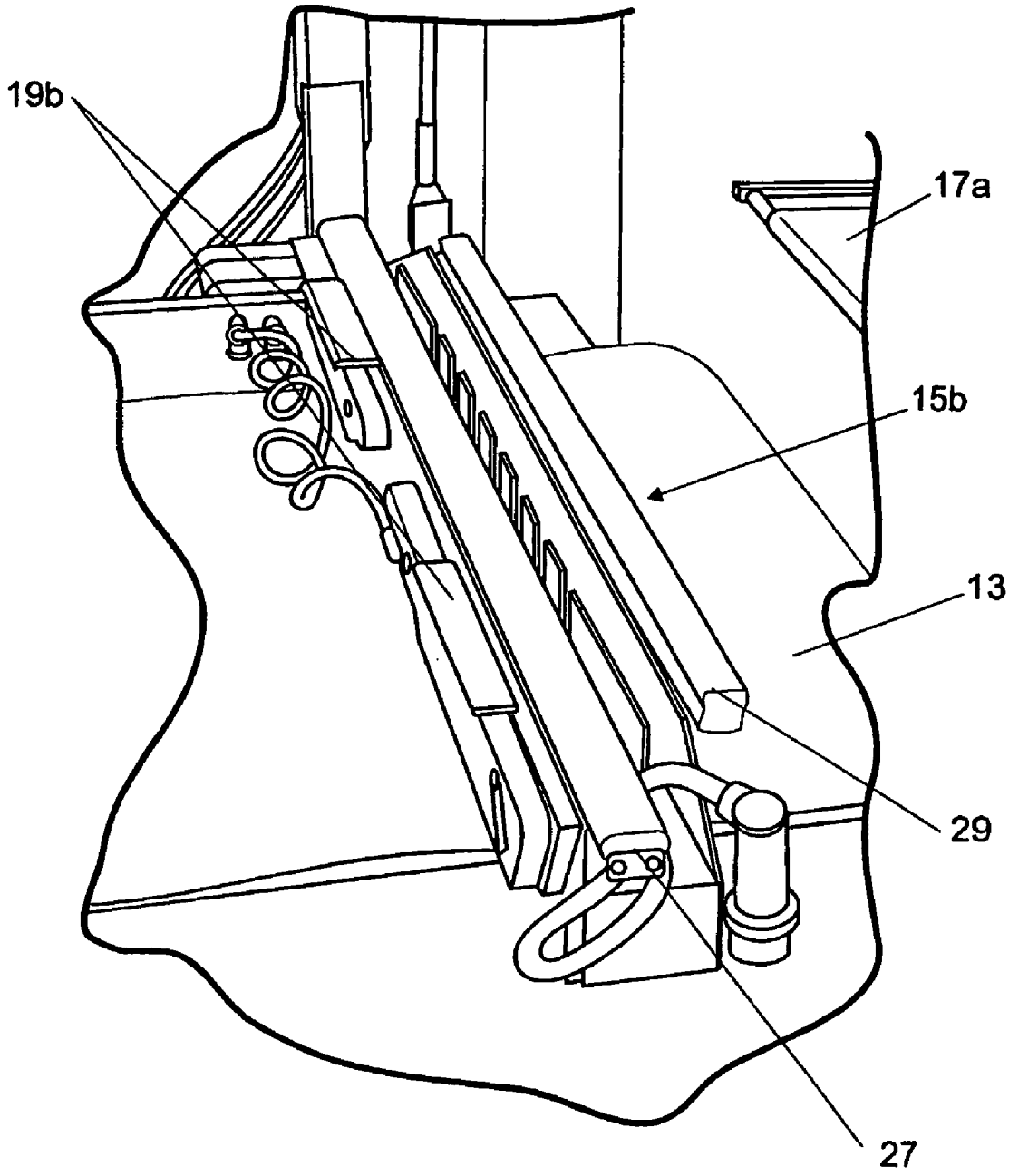
FIG. 7 is a perspective view of the lower part of the sealing assembly of FIG. 4.

With reference to FIGS. 1 to 3, an embodiment of a vacuum packaging machine is indicated generally by reference numeral 1. The vacuum packaging machine includes upper and lower vertically stacked vacuum chambers 3*a*,3*b*, which are vertically moveably mounted between columns 5. Mounted adjacent the tops of the columns 5 is a drive mechanism 7 for the vacuum chambers 3*a*, 3*b*, the drive mechanism being described in further detail below with reference to FIGS. 8 and 9.

An electronic control system 8 controls operation of the machine 1, and a keypad/monitor 10 is provided to enable a user to program the control system.

Each vacuum chamber 3*a*, 3*b* includes a bed 9 and a chamber hood 11. The beds 9 are synchronously vertically movably mounted between the columns 5, and each chamber hood 11 is vertically moveable relative to the respective bed 9. The chamber hoods 11 are moved via pneumatic rams 12. Alternative drive means could be used such as hydraulic rams or mechanical means.

Each vacuum chamber has a sealing assembly 15 therein, which will be described in more detail below with reference to FIGS. 4-7. The bed 9 of each vacuum chamber includes a conveyor 13 to convey packaged product out of the chamber after it has been vacuum sealed, the direction of travel of the conveyor 13 defining a longitudinal direction of the vacuum chamber.

A conveyor arrangement is provided to load/unload product packages to/from the vacuum chambers. The conveyor arrangement includes an infeed conveyor 17 to load product packages into the vacuum chambers. The operation of the infeed conveyor 17 will be described in further detail below. An outfeed conveyor (not shown) is also provided to remove packaged product from the machine following sealing.

As can be seen from FIGS. 1-3, the vacuum chambers are moveable together between a lower position (shown in FIGS. 1 and 2) wherein the upper chamber 3*a* is adjacent the infeed conveyor 17 for loading/unloading and an upper position (shown in FIG. 3) wherein the bed of the lower chamber 3*b* is adjacent the infeed conveyor 17 for loading/unloading. While one of the vacuum chambers is in the loading/unloading position, the other chamber is in an operating position to perform a vacuum sealing operation on the package(s) contained therein. Therefore, the operating position for the upper vacuum chamber 3*a* is above the level of the infeed conveyor, while the operating position for the lower vacuum chamber 3*b* is below the level of the infeed conveyor.

Having one of the vacuum chambers open for loading/unloading while the other of the vacuum chambers is performing the vacuum sealing operation results in a reduced cycle time over that provided by a conventional vacuum packaging machine.

As can be seen from FIGS. 4-7, the sealing assembly 15 in each vacuum chamber includes an upper part 15*a* and a lower part 15*b*. The sealing assembly 15 extends transversely to the longitudinal direction of the vacuum chamber, and therefore to the direction of travel of product packages through the chamber. This enables the product package to be delivered to the vacuum chamber with its unsealed portion trailing, which is the orientation in which the product package would exit from prior bagging/wrapping stations.

The upper part 15*a* of the sealing assembly includes a pair of upper spreaders 19*a*, a heat seal anvil 21, a puncturing device having a plurality of piercing knives (not shown), and a clamping device 23 having a series of clamping pins 25. The lower part 15*b* of the seal assembly includes a pair of lower spreaders 19*b* which are complementary to the pair of upper spreaders 19*a*, a heat seal bar 27, and a lower clamp bar 29. It will be appreciated that the anvil could be provided in the lower part 15*b* of the seal assembly, with the heat seal bar provided in the upper part 15*a* of the seal assembly.

In this particular embodiment, the spreading operation is as follows. The spreaders 19*a*, 19*b* are operable to grip and spread the unsealed part of the product package prior to heat sealing. As will be apparent from the Figures, as the upper 19*a* and lower 19*b* spreaders are brought together, they move outwardly by virtue of the angled slots 20*a* and pins 20*b* extending therethrough. The spreaders function in a similar way to those described in PCT Publication No. WO 02/10019, the disclosure of that publication being incorporated herein by reference.

Alternative spreading systems can be used. In one alternative, an air "curtain" provided by a series of small air jets is provided to blow the unsealed package neck flat over the seal bar.

Another embodiment would include restricting the air flow out of the product package during the vacuuming process, and using the resulting back pressure created to spread the neck of the package over the heat seal bar. This restriction may take the form of a bar spaced a fixed distance above the heat seal bar or alternatively a lightly spring-loaded or gravity bar.

These embodiments are examples only, and other automatic spreading systems can alternatively be used.

Another embodiment is described below with reference to FIGS. 20 to 22A through 22E, which includes the formation of a presentation seal on the product package prior to vacuum sealing, to maintain some tension in the region to be sealed.

The clamping pins 25 and lower clamp bar 29 (which would generally be made from a resilient material such as rubber) maintain the unsealed portion of the package in the spread configuration, and provide tension on the product package such that it can be pierced. When the puncturing device is actuated, the knives (not shown) pierce the package. The puncturing device forms small apertures in the product package. During loading of the product package into the vacuum chamber, it is feasible that the trailing unsealed portion of the package may be located such that it will be clamped under the end wall of the vacuum chamber hood 11 when it is closed. The apertures formed by the puncturing device ensure that any air in the product package may still be evacuated if this should occur.

The heat seal anvil 21 is operable to push against the heat seal bar 27 with the unsealed portion of the product package therebetween, applying a current to the heat seal bar and sealing the product package.

Although not shown in the Figures, a suitable cutting device is provided to cut the product package between the heat seal bar 27 and the puncturing device. An example of a cutting device is a serrated knife, which is arranged to move downwards from above to shear the product package.

Although not shown in the Figures, the machine can include a scrap removal device to remove the cut-off portions of the product package from the machine. An example is a "push-pull" system, in which a series of air jets are provided on the top front face of the heat seal bar. After the unused product package neck has been cut and the chamber opens, the cut portion of the neck will be supported on the clamping bar 29. When the chamber opens this clamping bar will drop down to its home position while the air jets are simultaneously activated. This action will blow the severed bag neck toward a suction system which is mounted below the nose roller of the telescoping infeed conveyor 17. A second set of air jets may also be provided along the bottom of the heat seal bar, just above the internal conveyor 13, to create a full air curtain blowing toward the suction system. An advantage of this product loading/chamber system is the relatively small distance between the air jet and the suction system (approximately 100 mm). In a conventional rotary system the scrap has to be blown transversely across a gap of approximately 600 mm. Other means of removing scrap can be used.

The belt of the conveyor 13 extends under the lower part of the seal assembly 15*b*, and around the outer ends of the bed 9 of the vacuum chamber. For this purpose, the undersurface of the conveyor belt comprises a smooth surface (relative to a conventional cloth surface), for example a smooth elasticized surface, such that the vacuum chamber can seal over the belt.

In order to deliver the product package over the lower part 15*b* of the seal assembly, the infeed conveyor has a telescoping portion 17*a*. During loading of an open vacuum chamber, the telescoping portion 17*a* extends over the lower part 15*b* of the seal assembly, and is operated to drop the body of the product package onto the conveyor 13 on the bed 9 of the vacuum chamber. The trailing unsealed portion of the packaged product will remain located on the telescoping portion 17*a* of the infeed conveyor. As the telescoping portion 17*a* is retracted away from the vacuum chamber so that the vacuum chamber can be moved and closed, the trailing unsealed portion of the product package will drop onto the lower part 15*b* of the seal assembly, so that the unsealed portion can be spread and sealed. The seal assembly 15 is relatively low profile to minimize the product drop distance as the telescoping portion 17*a* of the conveyor is extended into the vacuum chamber.

Figure 8:
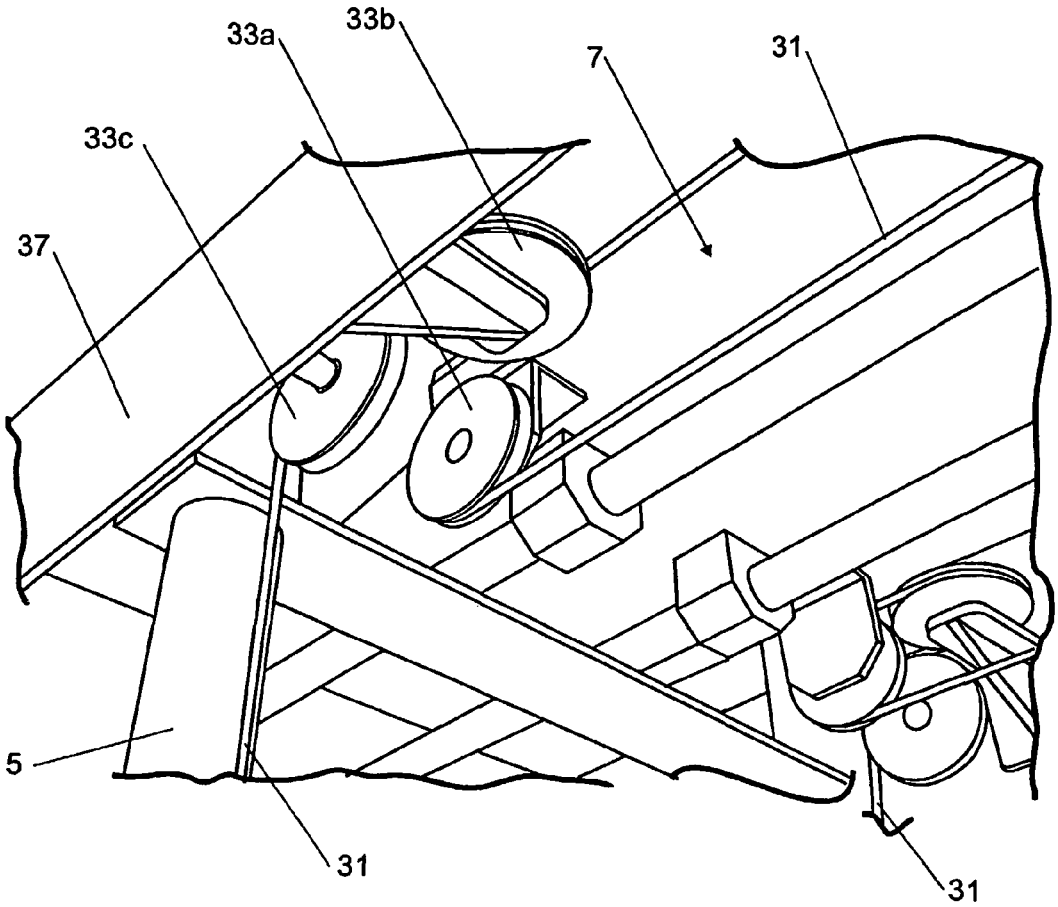
FIG. 8 shows part of a pulley arrangement for raising and lowering the vacuum chambers in the machine of FIG. 1.
Figure 9:
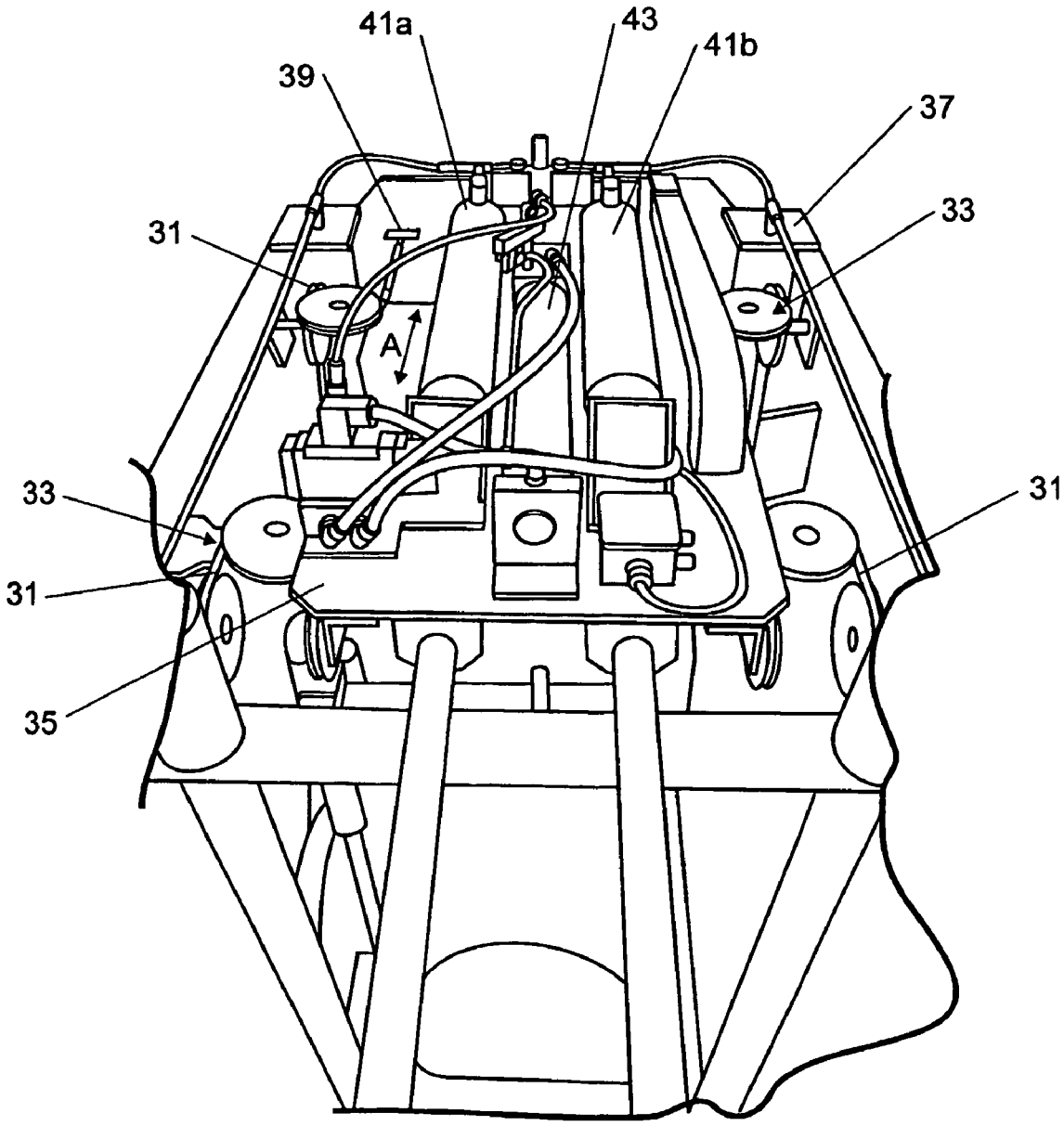
FIG. 9 is an overhead end view of the machine of FIG. 1.

In this embodiment, the vertical position of the vacuum chambers is adjusted by means of a drive mechanism 7 comprising a cable and pulley system as shown in FIGS. 8 and 9. The vacuum chambers are suspended by four cables 31 which extend downwardly to the vacuum chamber beds 9 adjacent each column 5 of the machine, not all of the cables being visible in the Figures. A triple arrangement of pulleys 33 is provided adjacent each corner of the machine. A main drive bed 35 is drivable in a horizontal plane as indicated by Arrow A in FIG. 9, and at each corner one pulley 33*a* is retractably attached to the main drive bed 35, while the other two pulleys 33*b*, 33*c* are rotatably attached to a stationary framework 37. One end of each cable 31 is operably attached to the vacuum chamber beds 9, while the other end of each cable is attached to the framework 37 as indicated by reference numeral 39 for example.

By virtue of the above configuration of pulleys and cables, horizontal movement of the drive bed 35 results in synchronized raising or lowering of the vacuum chamber beds 9.

The pulley configuration is such that horizontal movement of the drive bed 35 results in a vertical movement of the vacuum chambers of double the magnitude. For example, a top stroke of the drive bed 35 of 400 mm results in a vertical movement of the vacuum chambers of 800 mm. However, this 2:1 ratio of vacuum chamber movement versus drive bed movement requires twice the power that would be required for a 1:1 ratio.

To compensate for this, two constant pressure cylinders 41*a*, 41*b* are provided to counterbalance the weight of the vacuum chambers. The constant pressure cylinders may be hydraulic or pneumatic cylinders. These cylinders 41*a*, 41*b* are isolated with their own pressure vessels, which in this embodiment are the vertical columns 5 of the machine. The cylinders 41*a*, 41*b* hold the vacuum chambers in equilibrium, meaning that a lesser amount of force is required to vertically move the vacuum chambers than would otherwise be required.

A further cylinder 43 drives the bed 35 movement and thereby the vertical movement of the vacuum chambers 3*a*, 3*b*. By virtue of the constant pressure cylinders 41*a*, 41*b* counterbalancing the weight of the vacuum cylinders, only 14% of the compressed air which would otherwise be required to vertically move the vacuum chambers is needed, resulting in energy savings. Also, as the two cylinders 41*a*, 41*b* which counterbalance the weight of the pressure vessels are isolated with their own pressure vessels 5, in the event of mechanical failure or sudden loss of air supply, the vacuum chambers 3*a*, 3*b* will not crash down, resulting in improved safety.

Figure 13:
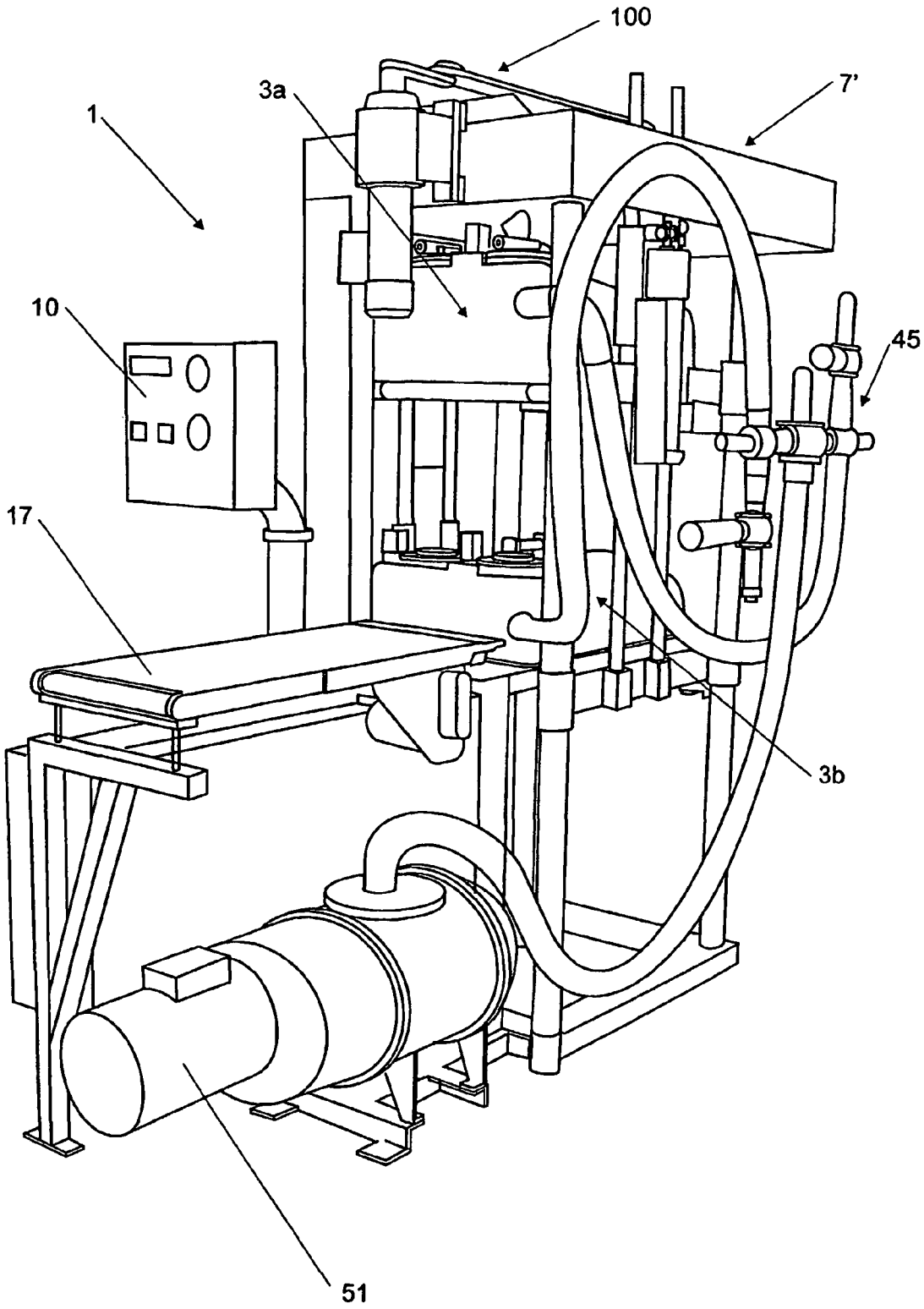
FIG. 13 is a perspective view of a vacuum packaging machine in accordance with another embodiment of the present invention.

In an alternative embodiment, the vacuum chambers may be raised and lowered by a crank 100, as shown generally in FIG. 13. In this embodiment the drive bed 35 is moved by a 180° turn of the crank arm. If the crank arm is 200 mm long, and this arm is linked to the drive bed 35, rotating the arm by 180° will move the bed 400 mm, which in turn will move the vacuum chambers 800 mm. This crank system can move the chambers slowly as the crank moves off its 0° position, ramping to a maximum speed as the crank moves through the 90° position, and decelerating to a stop as the crank moves to the 180° position. The net result is that a smooth chamber motion is provided, with an accurate end stop positioning.

Figure 14:
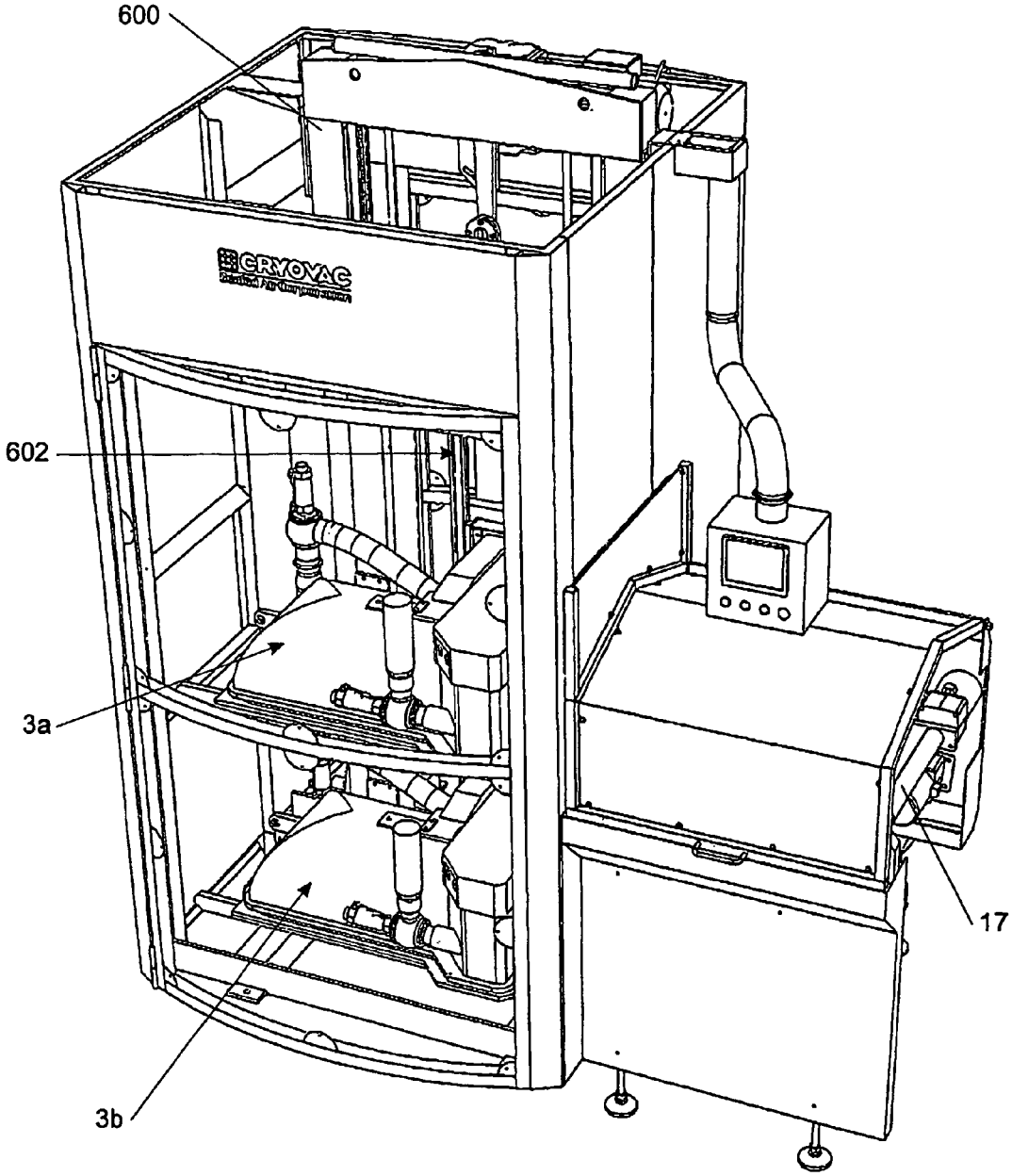
FIG. 14 is a general external view of a vacuum packaging machine in another embodiment of the present invention.
Figure 15:
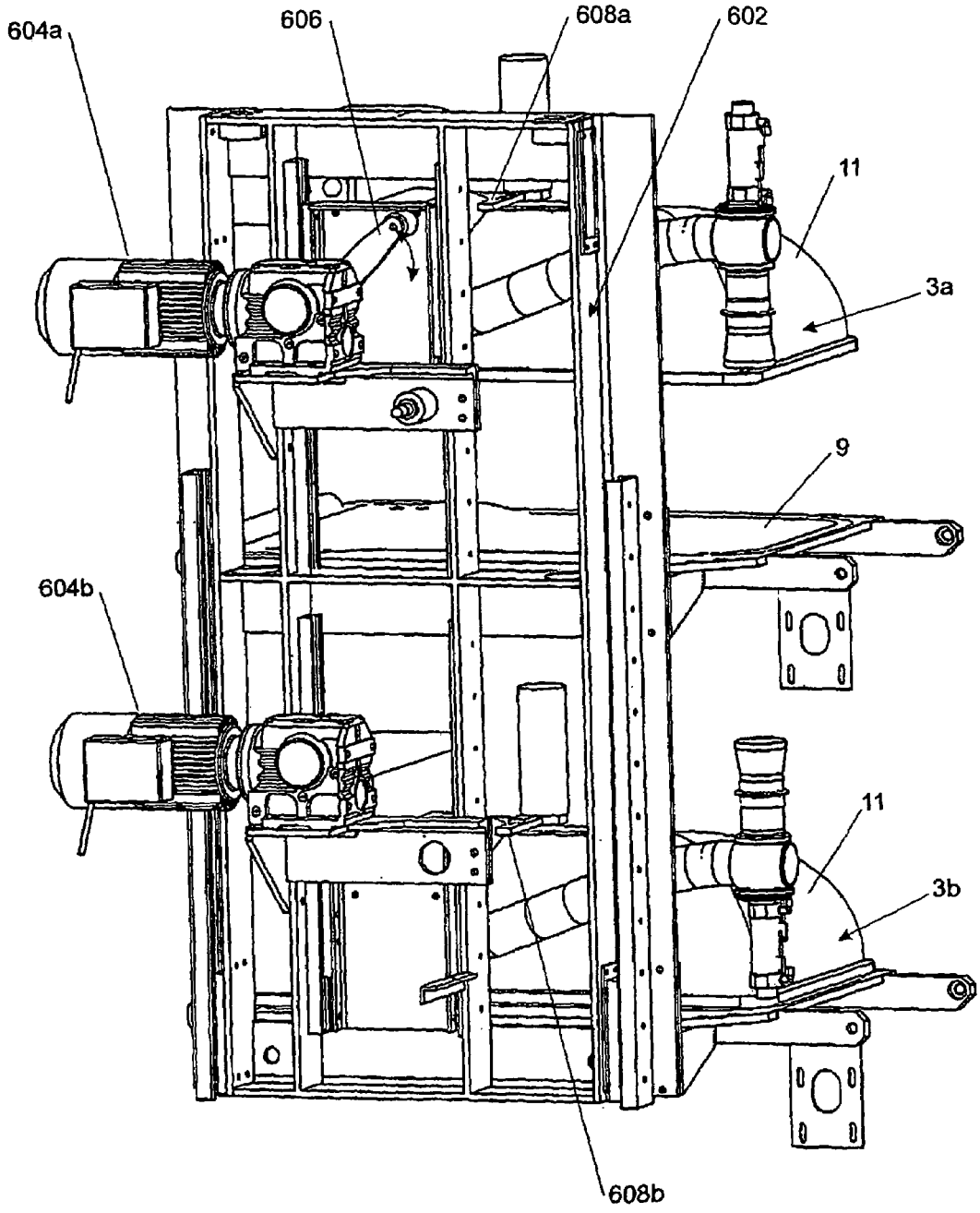
FIG. 15 is a partial side view of the vacuum packaging machine of FIG. 14.
Figure 16:
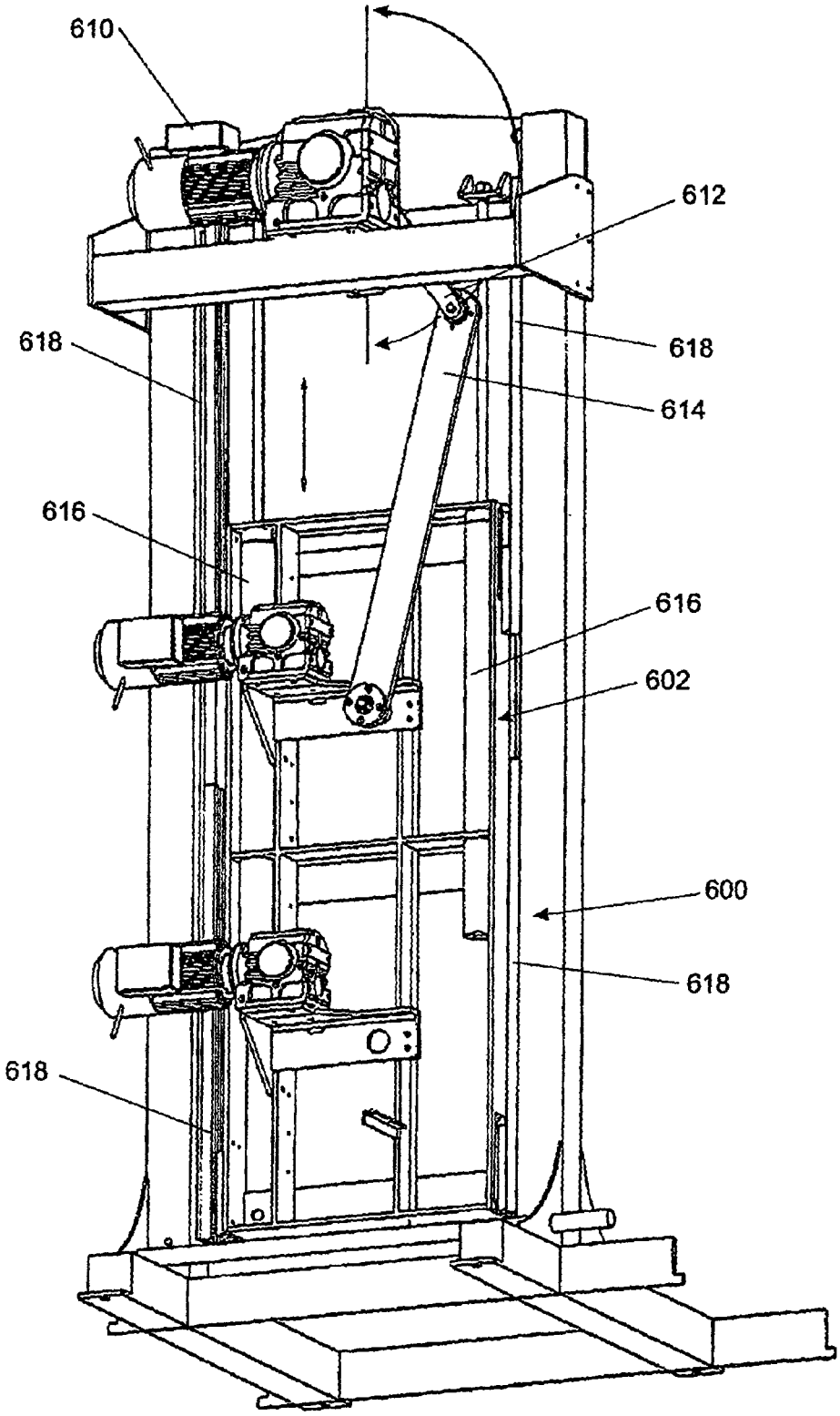
FIG. 16 is a partial side view of the framework and crank system used in the vacuum packaging machine of FIG. 14.

An alternative crank arrangement is shown in FIGS. 14 to 16. This system has a framework on one side of the vacuum chambers, which framework includes an outer fixed main frame part 600 and an inner sub-frame part 602 mounted for vertical movement relative to the main frame part 600. As shown in FIG. 15, the two vacuum chamber beds 9 are fixed relative to the sub-frame part 602, such that as the sub-frame part 602 moves vertically, the beds 9 of the vacuum chambers synchronously vertically move. Two electric motors 604*a*, 604*b*, are mounted on the sub-frame part 602, and thereby synchronously vertically move with vertical movement of the sub-frame part 602. Extending from each motor 604*a*, 604*b* is a respective crank arm 606 (only the upper one of which is shown in FIG. 14). The crank arms 606 are attached to respective lifting arms 608, which in turn are attached to respective vacuum chamber hoods 11. By this arrangement when, for example, the upper motor 604*a* is operated, the upper crank arm 606 will rotate, thereby moving the upper lifting arm 608*a*, moving the upper vacuum chamber hood 11 relative to the upper vacuum chamber bed 9. Similarly, actuation of the lower motor 604*b* will result of rotation of the lower crank arm, and movement of the lower lifting arm 608*b*, thereby moving the lower vacuum chamber hood 11 relative to the lower vacuum chamber bed.

In one embodiment, a 180° rotation of each crank arm 606 will result in about 300 mm vertical movement of the respective vacuum chamber hood from the respective vacuum chamber bed.

As outlined above, the vacuum chamber beds 9 are fixed relative to the sub-frame part 602. With reference to FIG. 16, a further electric motor 610 is provided, which is mounted on the outer fixed main frame part 600. A crank arm 612 extends from the electric motor 610, and is coupled to a crank link 614, which in turn is connected to the sub-frame 602. Operation of the motor 610 results in rotation of the crank arm 612 (as indicated by the arrow in the Figure), which in turn results in movement of the crank link 614 and thereby vertical movement of the sub-frame part 602 relative to the main-frame part 600. This vertical movement results in synchronous vertical movement of the two vacuum chamber beds 9 so that the vacuum chambers can be moved from their loading to their operating positions. In the preferred embodiment, a 180 degree rotation of the crank arm 612 will result in about 700 mm vertical movement of the sub-frame part 602.

Pneumatic balancing cylinders 616 are provided to reduce the load applied to the motor 610. In one embodiment, the main frame part 602 is also the air reservoir for the balancing cylinders 616. The motors 604*a*, 604*b*, 610 will generally be provided with gearboxes to obtain the desired outputs.

A number of linear bearing guides 618 are provided between the main frame part 600 and the sub-frame part 602, which constrain movement of the sub-frame part 602 to the vertical.

Figure 10:
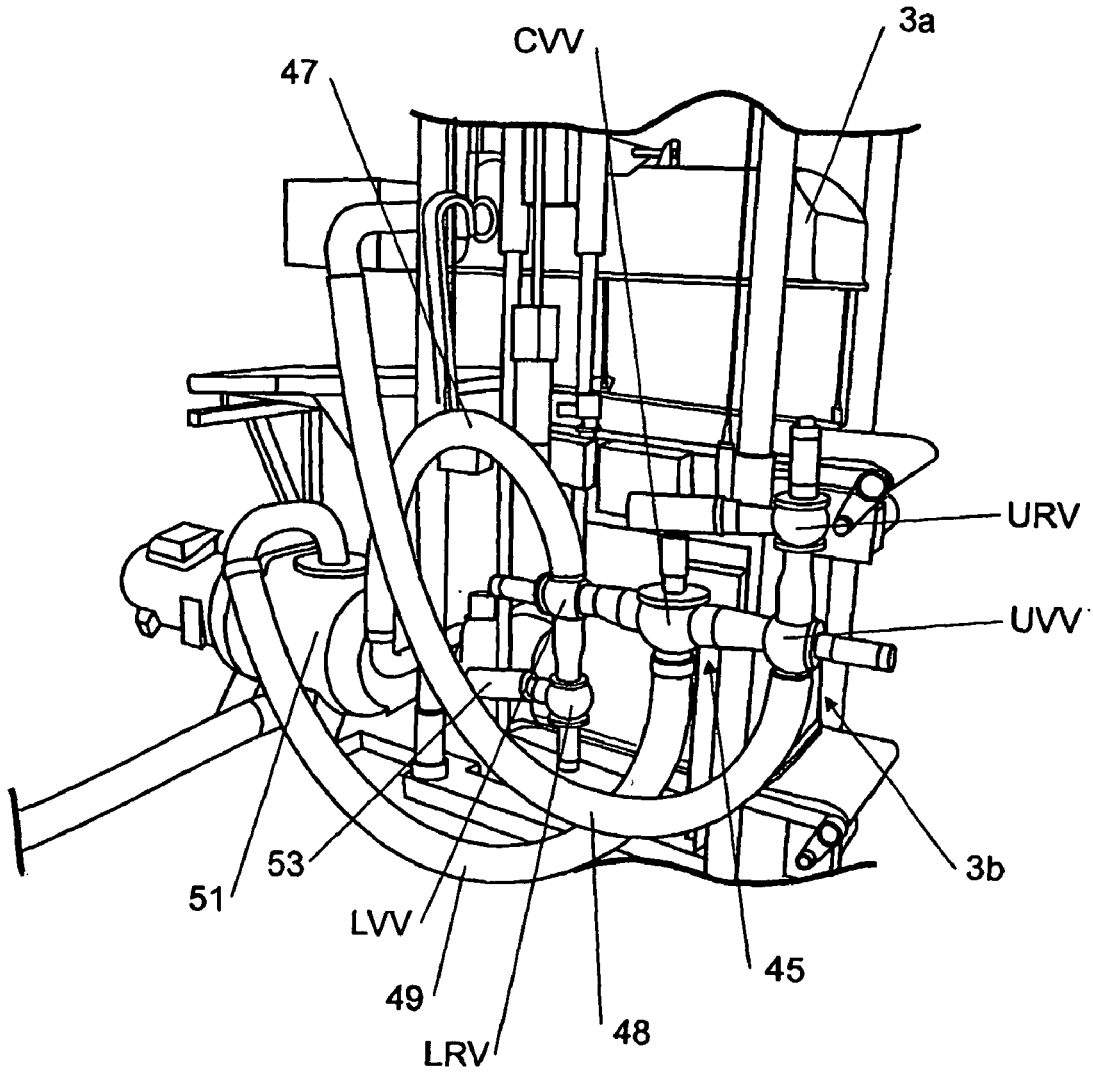
FIG. 10 is a side elevation view of the machine of FIG. 1, showing a cross-flow valve mechanism for transferring vacuum between vacuum chambers.
Figure 11:
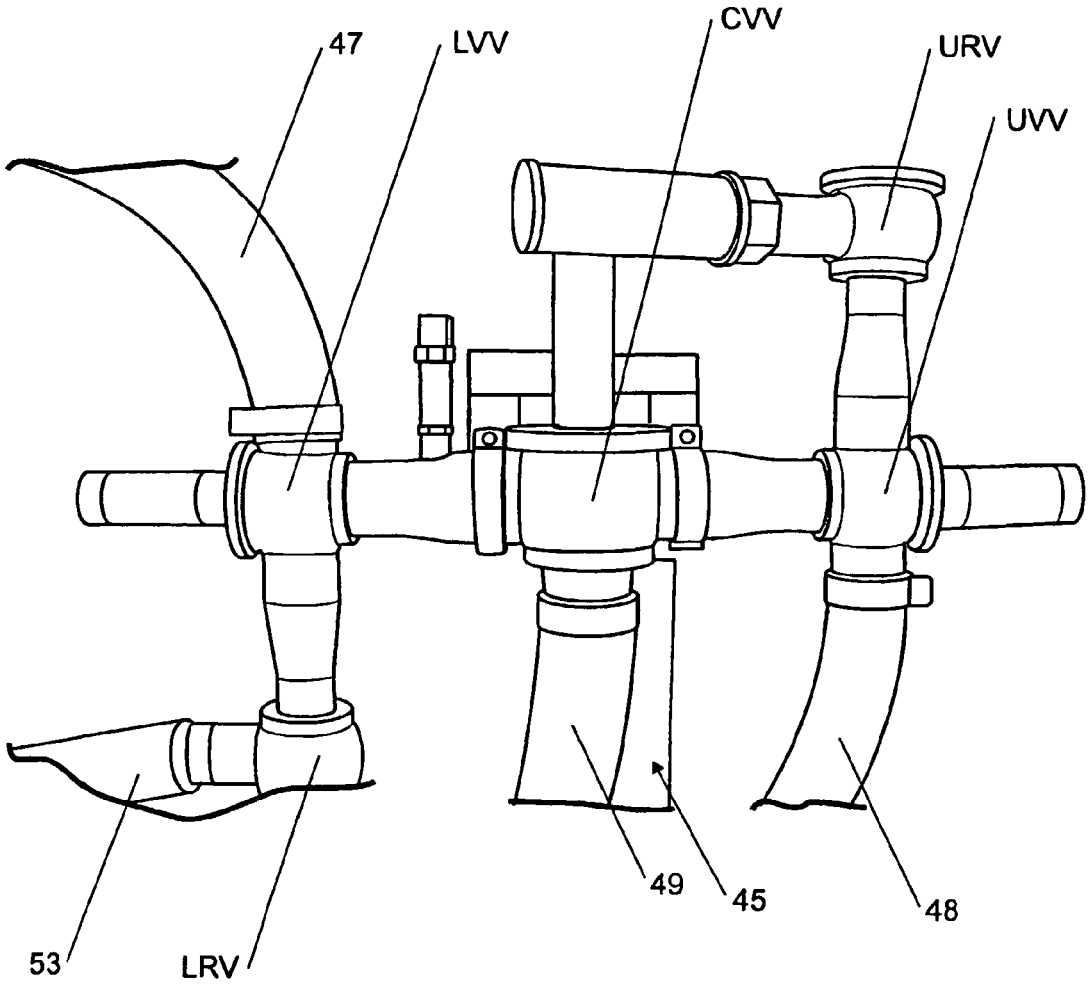
FIG. 11 is a further detailed view of the cross-flow valve mechanism of FIG. 10.
Figure 12:
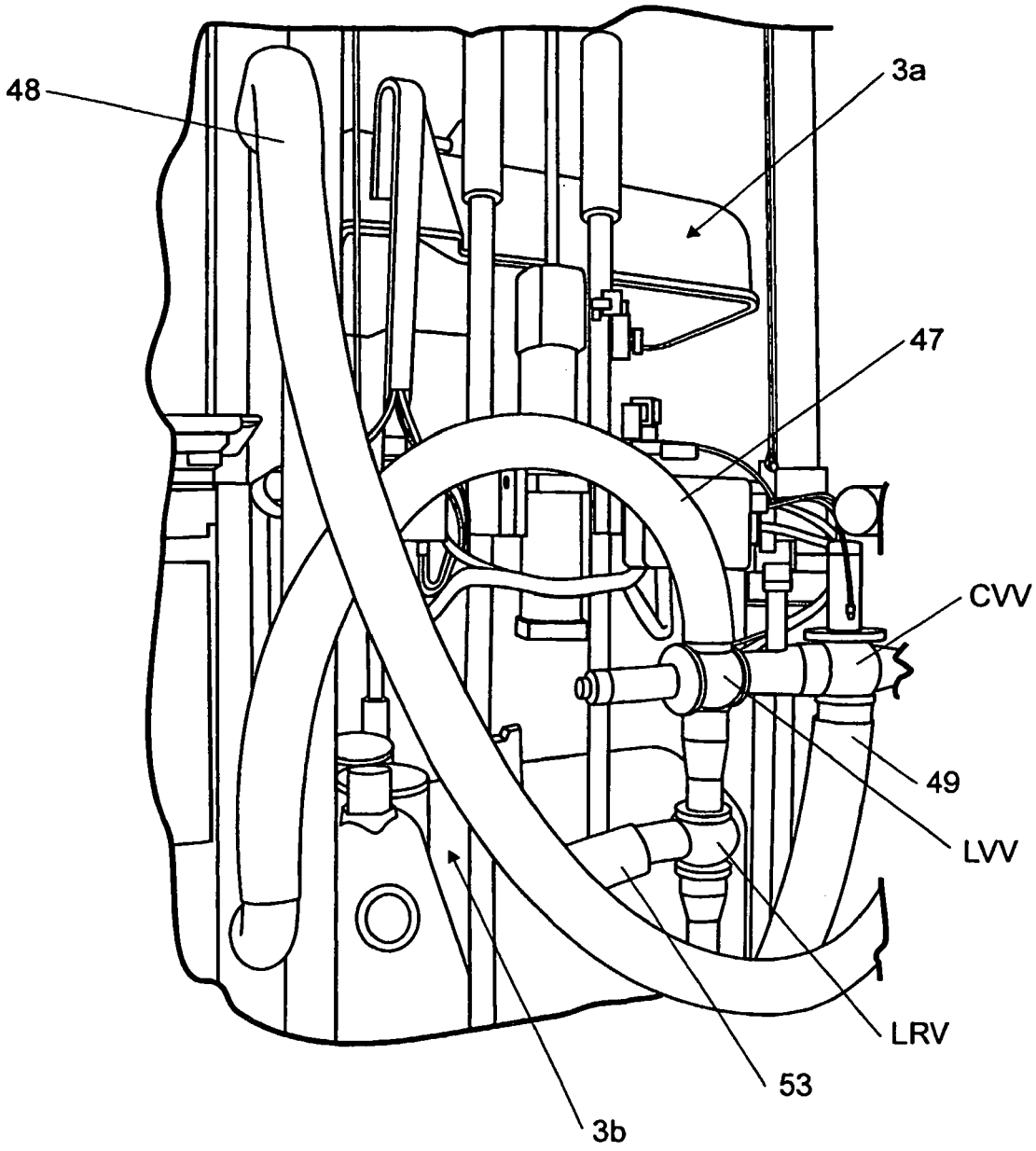
FIG. 12 is a further detailed view of the cross-flow valve mechanism of FIGS. 10 and 11.

The vacuum packaging machines of the above embodiments can include a cross-flow valve mechanism as indicated generally by reference numeral 45 in FIGS. 10-12. The purpose of the cross-flow valve mechanism is to transfer pressure from a recently-loaded vacuum chamber to a recently-evacuated vacuum chamber.

For the purpose of explanation, presume that the lower vacuum chamber 3*b* is being evacuated. Valve LRV is closed. Air from the lower vacuum chamber 3*b* travels through tube 47, through open valves LW and CVV, and out through tube 49 through a blower 51. Once the lower vacuum chamber 3*b* has been fully evacuated, valve CW is closed and valve LW is maintained in the open configuration, the vacuum thereby being held in the tube 47.

Simultaneously, the upper vacuum chamber 3*a* has been loaded, and once loading is completed, can be closed. Once the upper vacuum chamber has been closed, valve UW is opened, meaning that pressure will equalize between the upper and lower vacuum chambers through tubes 47 and 48. ½ atmosphere pressure will have transferred to the lower vacuum chamber 3*b*, both of the vacuum chambers thereby being at ½ atmosphere pressure. Then valve LW is closed, and valve LRV is opened, causing ½ atmosphere pressure to be sucked into the lower vacuum chamber 3*b* through a silencer 53. Simultaneously, valve CW is opened to allow the vacuumization process to be completed on the upper chamber.

By this time, the lower vacuum chamber will have been moved back to the loading/unloading position and will be at atmospheric pressure. Valve LW can then be closed as the lower vacuum chamber is opened to unload the packaged product therefrom and load a new unsealed product package. The process then repeats.

An advantage of utilizing the cross-flow valve mechanism to transfer the vacuum is that only ½ atmosphere of pressure needs to be removed from a vacuum chamber during an evacuation by the pump 51, resulting in significant cycle time reductions.

As mentioned above, the chamber hoods 11 are moved via pneumatic rams 12. Once the vacuum sealing has occurred in a vacuum chamber, and ½ atmosphere pressure has been transferred to the evacuated chamber, an opening force is applied by the rams 12. Once the vacuum is removed from the chamber, the vacuum hood opens under force.

Method of Operation

The vacuum packaging machine 1 would generally be located downstream from a manual, semi-automatic, or fully automatic bagging machine. The operation of the vacuum packaging machine in conjunction with a bagging or wrapping machine is described below with reference to FIGS. 20 to 22A through 22E. A fixed input conveyor (not shown) would deliver unsealed product packages to the infeed conveyor 17, the packages being oriented such that the unsealed portion of each package is trailing.

For the purpose of explanation, presume that the lower vacuum chamber 3*b* is in the lower operative position and is presently vacuum sealing a product package therein, and the upper vacuum chamber 3*a* is open and adjacent the infeed conveyor 17, ready for loading.

The infeed conveyor 17 is actuated such that the telescoping portion 17*a* extends over the seal assembly 15 and is operated to place a product package onto the conveyor 13 on the bed of the vacuum chamber 3*a*. As the telescoping portion 17*a* of the infeed conveyor 17 is retracted from within the vacuum chamber, the trailing unsealed portion of the product package falls onto the lower part of the seal assembly. The telescoping conveyor can be equipped with a sensing means to detect the trailing edge of the product and place it just beyond the seal assembly 15. In one embodiment, the detecting means is a capacitive sensor mounted in the bed of the telescoping conveyor 17.

The hood 11 of the upper vacuum chamber 3*a* can then be closed and ½ atmosphere pressure is transferred to the recently evacuated lower vacuum chamber as described above with reference to FIGS. 10-12. The chambers will move to their upper positions, and the lower chamber 3*b* will be fully depressurized, the chamber then being opened and the packaged product unloaded while the new product package is simultaneously loaded.

In the upper vacuum chamber 3*a*, the unsealed portion of the product package is spread by the spreading system. The puncturing device is then actuated, such that knives pierce the unsealed portion of the product package while the clamping pins 25 hold it in the spread configuration against the lower clamp bar 29. The spreader bars 19 are then released, and the vacuum chamber 3*a* is evacuated, through the cross-over and vacuum techniques previously described, thereby evacuating any air from the product package through its unsealed portion and/or the pierced apertures.

The heat seal anvil 21 then pushes against the heat seal bar 27, heat sealing the package therebetween. The cutting device then shears the scrap portion of the product package between the heat seal bar 27 and the puncturing device. The anvil 21 is then moved away from the heat seal bar 27. When the chamber moves to the loading/unloading position and opens, the packaged product and the scrap cut-off portion of the package will be released. The air curtain and suction are then actuated to remove the scrap from the vacuum chamber.

In the meantime, the lower vacuum chamber 3*b* will have already been loaded with a further unsealed product package, and ½ atmosphere pressure is again transferred between the vacuum chambers as described above. The cycle repeats, with the vacuum chambers moving to their lower positions such that the lower chamber is in the operative position and the upper chamber is in the loading/unloading position.

By utilizing a transversely mounted seal assembly and heat seal bar, the product packages can be fully automatically loaded and heat sealed in the orientation in which they exit a standard bagging and sorting machine, enabling the machines to be utilized as part of a fully automated in-line process.

By virtue of having vertically stacked vacuum chambers, some embodiments of vacuum packaging machines can have a footprint of about 1 $m^2$ as compared with 17 $m^2$ for a standard rotary machine.

The parallel system which enables one vacuum chamber to be loaded/unloaded while the other vacuum chamber performs a vacuum sealing operation results in a reduced cycle time.

Cycle time savings can sometimes be achieved by virtue of the transfer of pressure between the recently-loaded vacuum chamber and the recently-evacuated vacuum chamber, using the cross-flow valve mechanism.

While specific embodiments of the invention have been described above, modifications may be made thereto without departing from the scope of the invention:

For example, while the vacuum packaging machine shown in the Figures includes two vertically-spaced vacuum chambers, it will be appreciated that 3 or more vacuum chambers may be provided. In addition or alternatively, the vacuum chambers could be horizontally spaced, or a three dimensional (vertical/horizontal) array of vacuum chambers may be provided.

While the embodiments of the machine described above disclose the vacuum chambers being vertically moveable, alternatively the infeed conveyor 17 and outfeed conveyor (not shown) could be vertically moveable and the vacuum chambers fixed. Further, more than one of each of the infeed and outfeed conveyors may be provided to provide a system having higher capacity.

Embodiments described above load and seal one product package at a time. However, it will be appreciated that the infeed conveyor and vacuum chambers could be configured to load and vacuum seal two or more packages situated side-by-side.

Figure 17:
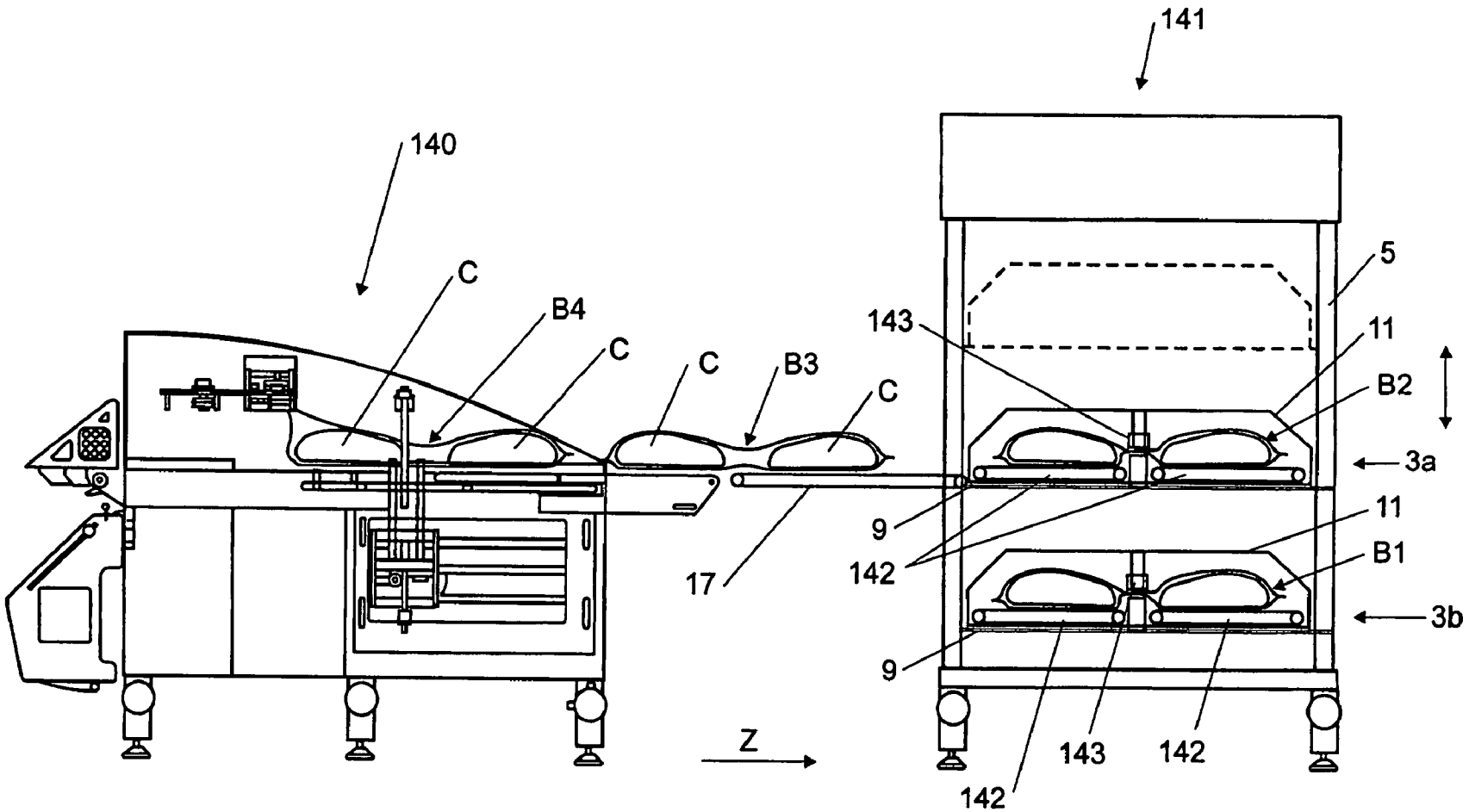
FIG. 17 is a schematic diagram of a vacuum packaging machine in accordance with another embodiment of the present invention, in combination with a wrapping machine.

FIG. 17 schematically illustrates an alternative vacuum packaging machine of the invention. The operation of the machine is generally similar to the machine of FIGS. 1-16 and unless indicated otherwise it should be understood that the detailed structure and componentry and operation of the preferred embodiment machine of FIG. 17 is similar to that of the machines of FIGS. 1-16. The machine comprises upper and lower vertically stacked vacuum chambers 3*a* and 3*b*, which as before are vertically moveably mounted between columns 5, and mounted adjacent the tops of the columns 5 is a drive mechanism (not shown in detail in FIG. 17) similar to that of FIGS. 8 and 9. An electronic control system controls operation of the machine and a keypad/monitor may be provided to enable a user to program the control system.

Each vacuum chamber 3*a*, 3*b* includes a bed 9 and a chamber hood 11. The beds 9 are synchronously vertically moveably mounted between the columns 5, and each chamber hood 11 is vertically moveable relative to the respective bed 9, again by pneumatic rams for example. An infeed conveyor 17 loads product packages into the vacuum chambers, from a wrap and seal machine 140 as will be described, and an outfeed conveyor (not shown) is also provided to convey the packaged products from the machine following sealing.

Operation of the machine is broadly similar to operation of the machines of FIGS. 1-16. The infeed conveyor 17 delivers product to one or other of the vacuum chambers when in the center position and open (vacuum hood raised). The hood of the vacuum chamber into which the unevacuated package has been delivered then closes and the vacuum chamber moves upwardly or downwardly to the upper or lower position and evacuation and sealing of the package is carried out while the chamber is in this position, while the other vacuum chamber which has moved upwardly or downwardly to the center position is opened and vacuumed and sealed packages removed via the outfeed conveyor.

However, the vacuum packaging machine of this embodiment is arranged to receive packages containing two or more products per package, as shown. In one arrangement products may enter wrapping and sealing machine 140 prior to being carried by the infeed conveyor 17 to the vacuum packaging machine. In the wrapping and packaging machine products such as meat cuts C are moved on to a length of flat packaging material which is then wrapped over the meat cuts, heat sealed across the forward end of the package, the machine forms a longitudinal seal along the length of the package, and heat seals the trailing end of the package. The wrapped and sealed package containing the two meat cuts exits the wrapping and packaging machine and is carried by the infeed conveyor 17, and entered into an open vacuum chamber. In the preferred form the vacuum chambers include chamber conveyors 142 on the bed of the vacuum chambers as shown, which operate with the infeed conveyor 17 to carry arriving packages into and position them in the vacuum chambers, before the vacuum hood closes at the commencement of the evacuating and sealing operation. Arrangements of conveyors for delivering packages into, and positioning them in, the vacuum chambers are shown in FIGS. 17 and 18A through 18F and described further below.

A sealing and cutting assembly 143 is mounted generally centrally within each vacuum chamber. The sealing and cutting assembly 143 is arranged to seal and cut between the two meat cut products in each package after evacuation, to form two separate evacuated packages each containing a single meat cut, which then exit the machine. In one embodiment each sealing and cutting assembly 143 comprises two heat seal bars, or a double heat seal bar, which are arranged to form two generally parallel heat seals transversely across the package between the two products, and a blade or similar between the two heat seal bars which is arranged to cut between the two heat seals to form two separate packages.

The upper part of each sealing and cutting assembly 143 may include a pair of upper spreaders, a heat sealing anvil, a puncturing device having a plurality of piercing knives, and a clamping device similar to that described for the machine of FIGS. 1-16. The lower part of each sealing and cutting assembly 143 may include a pair of lower spreaders which are complementary to the upper spreaders, heat sealing bars, and a lower clamp bar. Operation of the spreaders, heat sealing bars, and cutting and clamping device is similar to that for the machine of FIGS. 1-16 except that the heat sealing and cutting is carried out across the package to form two separate evacuated packages. The spreader may operate more effectively in a machine in which the packages are sealed and contain trapped air when loaded into the machine (with the packages being punctured before evacuation) as the trapped air may assist in forcing any pleats or wrinkles out as the spreaders operate. The heat sealing bars can be either in the upper or lower part of the sealing and cutting assembly, with the anvil in the other of the upper or lower part.

In an alternative configuration the two meat cuts or products instead of passing through a wrapping and sealing stage 140 before entering the vacuum packaging machine may be placed within a single long bag formed from tubular material sealed at one end, or a tube not sealed at either end. The bag or tube containing the two products is entered into a vacuum chamber containing an additional heat sealing mechanism at one end as in the machine of FIGS. 1-14, or heat sealing mechanisms at either end, as well as the central sealing and cutting mechanism 143, so that after evacuation the bag is sealed at its open end, or a tube is sealed at both ends, as well as being sealed and severed centrally. With this arrangement no puncturing mechanism would be required to be associated with the sealing and cutting assembly 143.

Figure 18A:
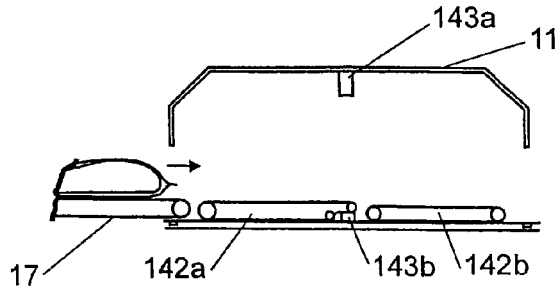
FIGS. 18A, 18B, 18C, 18D, 18E, and 18F, and 19A, 19B, 19C, 19D, 19E, and 19F show possible arrangements of infeed, chamber, and outfeed conveyors for delivering packages into, positioning them in, and delivering packages from the vacuum packaging machine of FIG. 17.
Figure 18B:
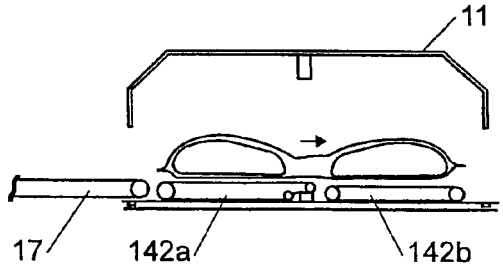
Figure 18C:
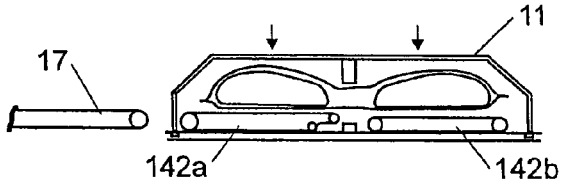
Figure 18D:
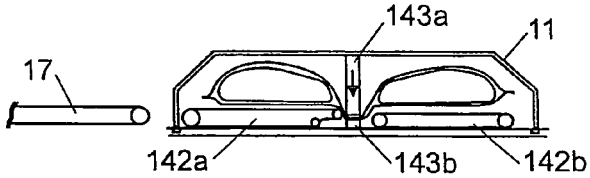
Figure 18E:
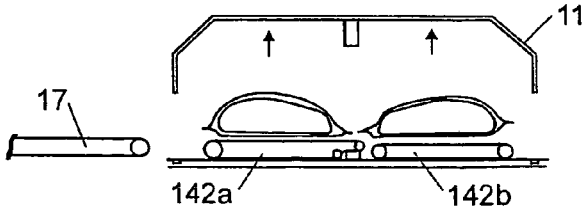
Figure 18F:
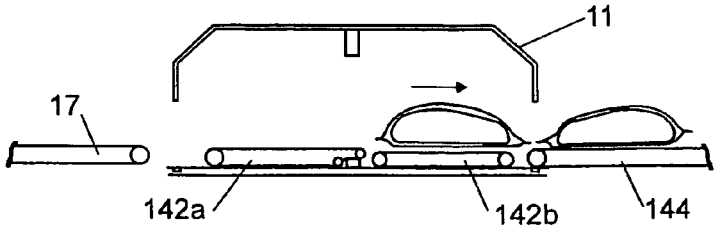

FIGS. 18A through 18F show one possible arrangement of infeed conveyor 17 and chamber conveyors 142 which operate to carry arriving packages into and position them in the vacuum chambers, before the vacuum hood 11 closes at the commencement of each evacuating and sealing operation. Chamber conveyors 142*a* and 142*b* are provided within the or each vacuum chamber. The forward end of conveyor 142*a* (right hand end in FIG. 18A) can extend over the part 143*b* of sealing and cutting assembly 143 (part 143*b* typically being a heat seal anvil 21 referred to previously). In operation and referring to FIGS. 18A through 18F, a wrapped and sealed package containing the two meat cuts exiting the wrapping and packaging machine is carried by the infeed conveyor 17 towards the open vacuum chamber awaiting loading, as referred to previously. The forward end of chamber conveyor 142*a* extends over heat seal anvil or equivalent part 143*b* FIG. 18A) and the package is carried by the moving infeed conveyor 17 and chamber conveyors 142*a* and 142*b* into the vacuum chamber until the package is centered within the vacuum chamber (FIG. 18B) when the chamber conveyors 142*a* and 142*b* stop and the forward end of chamber conveyor 142*a* then retracts. The hood 11 of the vacuum chamber closes (FIG. 18C), then sealing and cutting assembly 143 operates to seal and cut between the two meat cuts in each package after evacuation to form two separate evacuated packages each containing a single meat cut (FIG. 18D), and the vacuum chamber then opens (FIG. 18E). At about the same time the forward end of chamber conveyor 142*a* re-extends over the lower part of the heat sealing and cutting assembly 143*b*, and the chamber conveyors 142*a* and 142*b* operate to deliver the two packages from the vacuum chamber, onto an outfeed conveyor 144 (FIG. 18F).

Figure 19A:
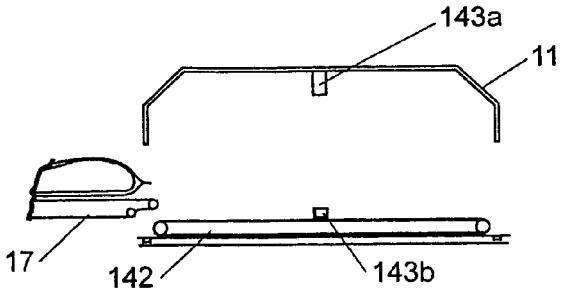
Figure 19B:
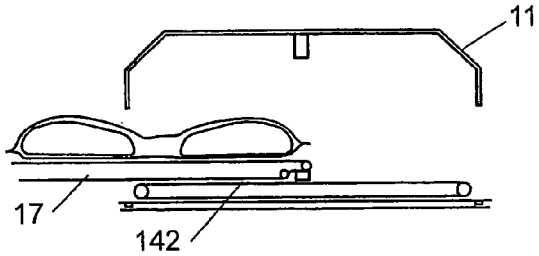
Figure 19C:
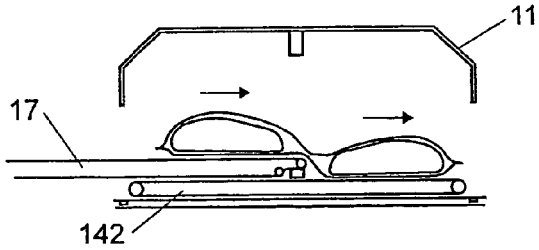
Figure 19D:
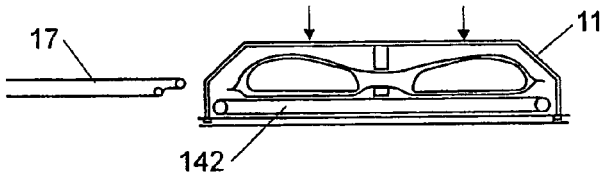
Figure 19E:
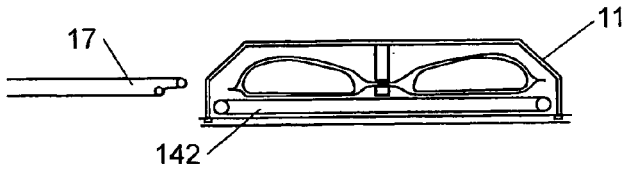
Figure 19F:
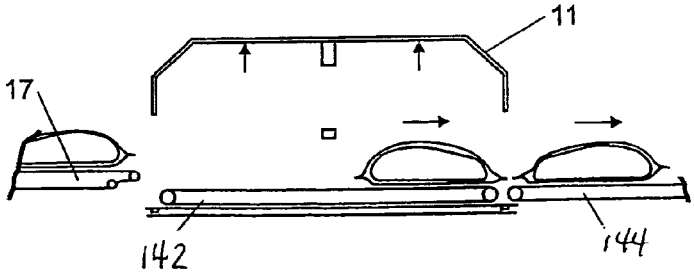

FIGS. 19A through 19F shows show another possible arrangement of conveyors for delivering packages into and positioning them in the vacuum chamber(s). In this arrangement infeed conveyor 17 has an extending forward end which enables the infeed conveyor 17 to extend into the open vacuum chamber and over the lower part e.g. heat seal anvil, of the sealing and cutting assembly 143 (see FIGS. 19B and 19C). In operation infeed conveyor 17 carrying a package containing two meat cuts (FIG. 19A) extends into the interior of an open vacuum chamber awaiting loading, and the forward end of the infeed conveyor 17 extends over the lower part 143*b* e.g. heat seal anvil of the sealing and cutting assembly (FIG. 19B) while the infeed conveyor is operating to deliver the leading meat cut within the package onto the forward end of the chamber conveyor 142 (right hand end in FIG. 19C). The infeed conveyor 17 then withdraws leaving the package containing the two meat cuts centrally on the chamber conveyor and the hood of the vacuum chamber closes (FIG. 19D). The sealing and cutting assembly 143 operates to seal and cut between the two meat cut products after evacuation to form two separate evacuated packages each containing a single meat cut (FIG. 19E) following which the vacuum chamber opens and the chamber conveyor 142 operates to deliver the two separate packaged meat cuts from the vacuum chamber and onto outfeed conveyor 144.

The arrangements of conveyors for delivering packages into and positioning them in the vacuum chambers shown in FIGS. 18A through 18F and 19A through 19F are described by way of example only, and other arrangements may be possible.

The vacuum packaging machine of FIG. 17 is arranged to seal and cut centrally between two products in a single package, to form two separate packages, but a larger vacuum packaging machine may have two or more spaced sealing and cutting assemblies similar to those 143 in each vacuum chamber and be arranged to seal and cut one long package containing three or more products, into three or more separate sealed and evacuated packages. Also a machine similar to that of FIG. 17 may be arranged to form a central seal across a package between two products or more on either side, to form two sealed and evacuated packages, each containing two or more products.

While an alternative embodiment vacuum packaging machine has been described with reference to FIGS. 17 to 19, modifications may be made thereto without departing from the scope of the invention:

For example, while the vacuum packaging machine shown in FIG. 17 includes two vertically-spaced vacuum chambers, it will be appreciated that three or more vacuum chambers may be provided. In addition or alternatively, the vacuum chambers could be horizontally spaced, or a three dimensional (vertical/horizontal) array of vacuum chambers may be provided While the embodiment of the machine shown in FIG. 17 has the vacuum chambers being vertically moveable, alternatively the infeed conveyor 17 and outfeed conveyor (not shown) could be vertically moveable and the vacuum chambers fixed. Further, more than one of each of the infeed and outfeed conveyors may be provided to provide a system having higher capacity.

While in one embodiment the vacuum packaging machine has vertically moveable vacuum chambers, the invention also contemplates a single vacuum chamber machine or a machine having a number of vacuum chambers but which do not move in the way described. One or more stationary vacuum chambers may each incorporate one or more sealing and cutting assemblies similar to those 143 in each vacuum chamber, so that packaged products entering the vacuum chamber are evacuated, and sealed and cut into two or more separate sealed and evacuated packages, which are removed from or exit the stationary vacuum chamber at the completion of vacuum and seal operation.

A seal and cutting assembly may also be incorporated in the vacuum chambers of a flat bed rotary vacuum machine or vertical (ferris wheel orientation) rotary machine, so that one package containing two or more products is entered into the vacuum chamber(s) of the rotary machine and evacuated and separated into two or more separate packages which exit the vacuum chamber on the outfeed conveyor from the rotary machine.

Using a vacuum packaging machine including the center sealing and cutting assembly, a range of sizes of packages sealed at both ends but of different lengths, in different production shifts or randomly in the same production shift, can be evacuated and sealed centrally in the one vacuum packing machine. Scrap i.e. the portion of the product package which is cut off after evacuating and sealing one end of an open bag package, is avoided, which avoids material wastage.

The embodiments described above with reference to FIGS. 17 to 19 load and seal one product package at a time. However, it will be appreciated that the infeed conveyor and vacuum chambers can be configured to load and vacuum seal two or more packages situated side-by-side.

The vacuum packaging machines of the embodiments described above with reference to FIGS. 1 to 18 may be used in combination with a machine or apparatus to provide presentation seals on the bags or packages as will be described below.

Figure 20:
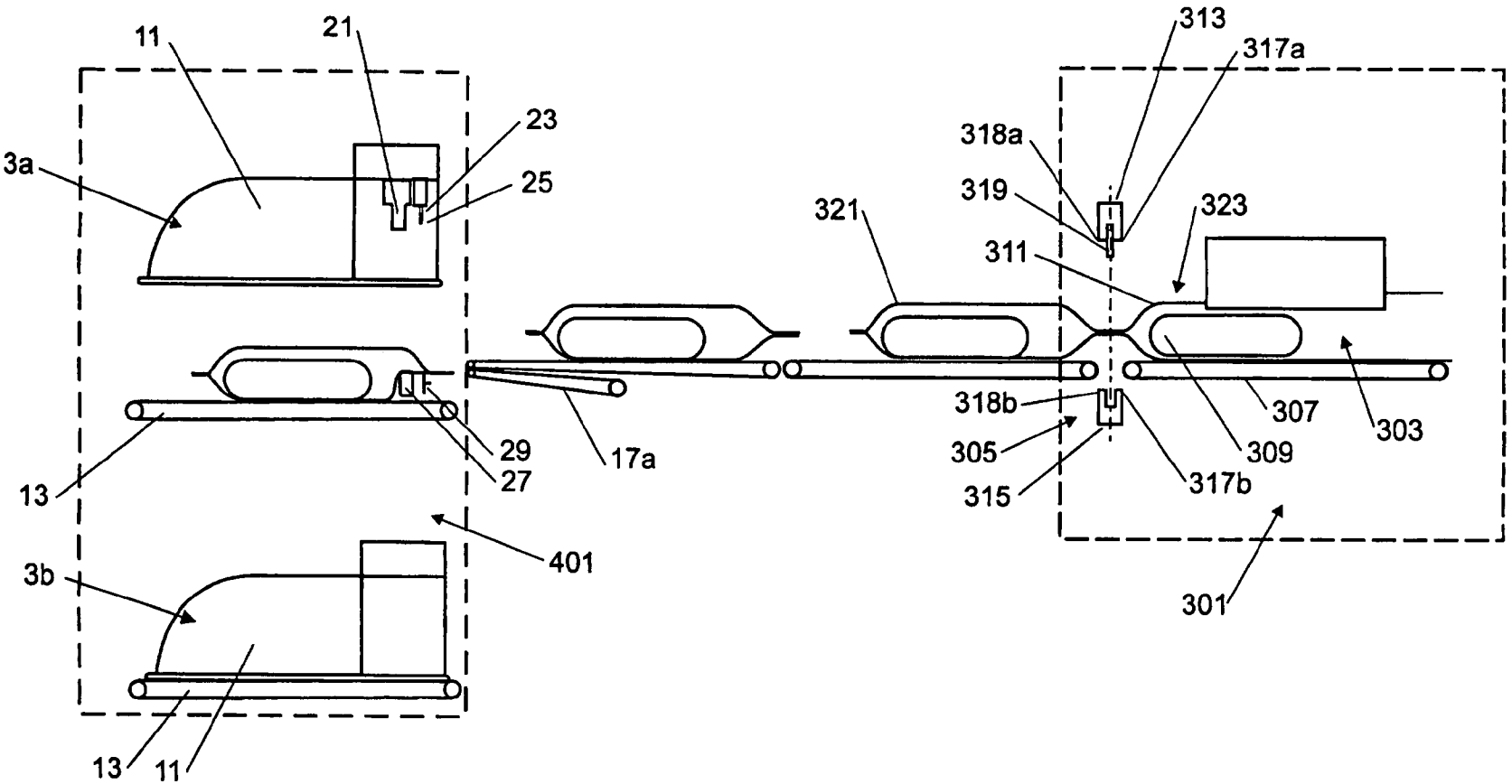
FIG. 20 schematically shows an embodiment of the vacuum packaging machine of FIGS. 1 to 16 in combination with a wrapping machine.

An automatic wrapping machine is shown in Box 301 of FIG. 20, and includes a wrapping zone 303 and a sealing mechanism 305. A conveyor arrangement 307 extends through the wrapping zone 303, and is configured to move a product 309 to be packaged through the wrapping zone in which the product is wrapped in suitable packaging material. Once the product is wrapped in the packaging material, it is moved by the conveyor arrangement 307 to the sealing mechanism 305.

As the product 309 is passed through the wrapping zone, it is surrounded by a sheet of flexible packaging material 311 to form a product package. The packaging material may be provided in tubular form, or alternatively one or more sheets of packaging material may be provided and the machine configured to form permanent seals along the longitudinal sides (direction relative to the path of the product through the packaging machine) of the product package.

As used herein, a "permanent" or "final" seal is one which would generally remain intact until a consumer unwraps the product after purchasing. A "emporary" or "presentation" seal is a seal which is typically of lower strength than the "final" seal and which is only required to remain intact until the vacuumization step as will be described below; it is not intended to be a final package seal.

The sealing mechanism 305 includes an upper member 313 and a lower member 315, which may be moved into contact with each other to form a seal on a product package, and which are separable to allow the product packages to move between the sealing members. The sealing mechanism 305 is configured to form two separate seals, a final seal and a presentation seal. To this end, the upper and lower members of the sealing apparatus each have a first sealing arrangement 317*a,b* and a second sealing arrangement 318*a, b*. In the embodiment shown, the sealing arrangements are in the form of respective heat seal bars 317*a*, 318*a* and anvils 317*b*, 318*b*. The upper member 313 is in the form of a double heat seal bar and the lower member 315 is in the form of a double anvil, although it will be appreciated that separate heat seal bars and anvils could be used if desired. A single anvil may be provided if desired, against which both bars or the double bar can act. The heat seal bars could be provided in the lower part of the sealing mechanism, with the anvils provided in the upper part of the sealing mechanism. When the heat seal bars 317*a*, 318*a* are brought into contact with the respective anvils 317*b*, 318*b* and an electric charge is passed through the heat seal bars, they form seals in the product packages. The first sealing arrangement 317*a,b* is configured to form a final seal, and the second sealing arrangement 318*a,b* is configured to form a presentation seal.

The sealing mechanism may have a spreader assembly to spread smooth the seal area prior to forming the presentation seal. The sealing mechanism may for example be of the type described in PCT Publication No. WO 02/10019.

A cutting device 319, such as a blade, is provided between the first and second sealing arrangements, so that once the seals have been formed separate product packages are provided.

It can be seen that the sealing mechanism 305 is configured to form the presentation seal at or adjacent the trailing edge of a product package 321 and to form the final seal at or adjacent the leading edge of the following product package 323. This configuration is suitable for use with the vacuum packaging machines described above with reference to FIGS. 1 to 15. However, if desired, the final seal could be formed at or adjacent the trailing edge of the leading package and the presentation seal could be formed at or adjacent the leading edge of the trailing package if a different configuration vacuum packaging machine is to be used. A single presentation seal or a pair of presentation seals could be formed between adjacent products in a product package for use in the vacuum packaging machines of FIGS. 17 to 19. In addition, a presentation seal could be formed at the end of such a package if a final seal is to be formed in the end of the package in the vacuum packaging machine. Further, the first and second sealing members could be provided in a wider spaced configuration so that the product can fit therebetween, and the seals could thereby be formed on a singe package.

In the embodiment shown, the presentation and final seals are formed concurrently. However, if desired for particular applications, they could be formed consecutively. Although not shown, the first 313 and second members 315 are moved by suitable actuators such as hydraulic, electric or pneumatic rams.

The presentation seal has sufficient strength to maintain some tension across the product package in the region of the presentation seal. The second sealing apparatus is configured to form a perforated or patterned seal, or may apply tack welds to form the presentation seal.

The product package with the presentation seal is then delivered by a conveyor arrangement to a vacuum packaging machine indicated by box 401. The operation of the machine is generally similar to the machine of FIGS. 1-16 and unless indicated otherwise it should be understood that the detailed structure and componentry and operation of the preferred embodiment machine is similar to that of the machines of FIGS. 1-16.

Other types of vacuum packaging machines may be used if desired, such as a rotary vacuum packaging machine or a single chamber vacuum packaging machine.

A primary point of difference is that by forming a presentation seal on the product package prior to vacuum packaging, a satisfactory seal can be obtained without the use of the spreader bars described therein in the vacuum packaging machine.

Each vacuum chamber 3*a*, 3*b* of the vacuum packaging machine can have a platen or bed with a conveyor 13, and a hood 11 which is moveable relative to the platen. A sealing arrangement is provided in the chamber and can comprise a transverse heat seal anvil 21 mounted on an independent actuator within the hood and a corresponding transverse heat seal bar 27. It will be appreciated that these components could be reversed if desired, so that the heat seal bar is in the upper part of the sealing arrangement and the anvil is in the lower part of the sealing arrangement.

A clamping device 23 preferably comprising a row 25 of clamping pins mounted on an independent actuator and a lower clamp bar 29 is provided to clamp the product package as required, as described above.

A piercing device (not shown) which may comprise a plurality of piercing knives is present between the heat seal bar and the clamping device. A cutting device can be provided to cut the package between the heat seal bar and the piercing device once the package has been sealed.

Method of Operation

Product 309 is fed into the wrapping zone 303 of the wrapping machine 301 on the conveyor arrangement 307, and is wrapped in flexible packaging material 311. If sheet packaging material is used, the wrapping machine forms longitudinal final seals along the sides of the product package. The conveyor arrangement then feeds the packaged product to the sealing mechanism 305 such that the heat seal bars 317*a*, 318*a* and respective anvils 317*b*, 318*b* are aligned with an empty area of the packaging between two of the packaged products. The seal bars and anvils are brought together to form a presentation seal on the trailing end of the leading product package 321 and a final seal on the leading edge of the trailing product package 323. Either concurrently with or following the sealing operation, the cutter 319 separates the two product packages between the seals.

In order to reduce cycle times, the sealing mechanism can be configured to form the final seal on the trailing product package 323 as it is still being formed by the wrapping machine as shown in the Figure.

A further conveyor then delivers the product to the vacuum packaging machine 401. When one of the vacuum chambers 3*a*, 3*b* is empty and open in a loading position aligned with the conveyor, a telescoping knife edge conveyor part 17*a* extends into the open chamber and is operated to drop the packaged product onto the platen into the position shown, such that the product is positioned on one side of the heat seal bar 27 and the presentation seal is positioned on the other side of the heat seal bar 27, and more preferably outside the lower clamp bar 29.

The conveyor part 17*a* is then moved out of the chamber, and the hood 11 is brought into contact with the platen to seal the product inside the chamber. As the hood 11 moves downwardly, the heat seal anvil 21 moves towards the heat seal bar 27, but does not come fully into contact therewith. The product package is compressed between the spaced heat seal bar 27 and anvil 21, which results in an increase in internal pressure in the product package such that it is positioned substantially flat and crease free against the heat seal bar 27 and anvil 21, and air from within the product package escapes through the presentation seal.

The end of the product package is then clamped by the clamping mechanism 23, 25, 29, pierced, and the chamber evacuated to vacuumise the product package. Once evacuated, the independent actuator is used to fully bring the heat seal bar 27 and seal anvil 23 together, and a current is applied to the heat seal bar to form a final seal on the package. Once sealed, the package is cut by the cutting device to remove the neck outside the recently-formed final seal, air is introduced back into the chamber, the chamber is opened, and the sealed product can be ejected from the chamber.

As the bags or packages are loaded, air may be captured therein as the presentation seal is formed. The advantage of capturing air is that the product package is then pushed flat against the heat seal bar and anvil in the vacuum chamber as they are brought towards each other when the chamber hood is closed and air is forced out through the presentation seal. However the capturing of air is not essential, and by simply providing a presentation seal on the package prior to vacuum sealing, it is believed that sufficient tension and/or mechanical rigidity will be maintained in the region of the presentation seal so that package sits relatively flat between the heat seal bar and anvil in the vacuum chamber.

The above describes a wrapping machine, and modifications may be made thereto without departing from the scope of the invention:

For example, while the sealing mechanism is provided as part of a wrapping machine, instead a suitable sealing mechanism could be provided as part of a bagging machine to form a presentation seal on pre-formed bags once product has been placed therein. It will be appreciated that as the bags will be provided to the bagging machine with three sides already sealed, it will not be necessary for the sealing mechanism in the bagging machine to form any final seals. Rather, it need only form the presentation seal on the open end of the bag once the product has been loaded therein.

Rather than being provided as part of the wrapping machine or bagging machine, the sealing mechanism could be provided separately in the production line between the wrapping or bagging machine and the vacuum chamber.

As described above, it may be advantageous to capture air in the product package prior to the formation of the presentation seal, so that as the package is compressed between the heat seal bar and anvil in the vacuum packaging machine, it is pushed flat against the heat seal bar and anvil in the vacuum chamber as they are brought towards each other when the chamber hood is closed and air is forced out through the presentation seal.

In the embodiment in which two products are provided in a single package and delivered to the vacuum chamber, the sealing mechanism may be configured to provide a temporary or presentation seal at either end of the package and/or in the middle of the package. A suitable configuration of heat seal bars would be provided in the vacuum packaging machine, so that each temporary seal is replaced by a final seal.

Figure 21:
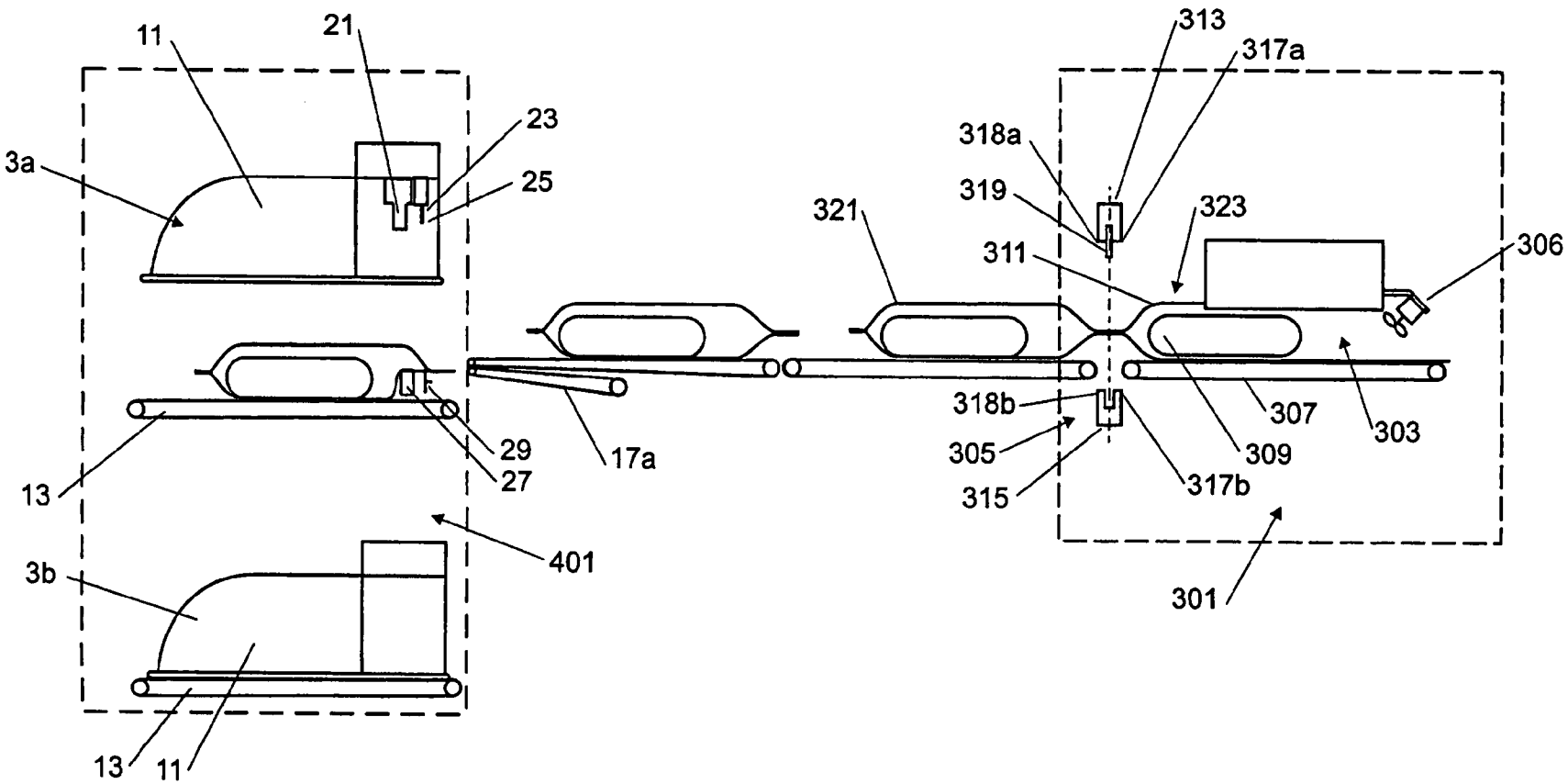
FIG. 21 schematically shows an embodiment of the vacuum packaging machine of FIGS. 1 to 16 in combination with a modified wrapping machine, the wrapping machine including a fan or blower.

Box 301 of FIG. 21 shows an alternative embodiment automatic wrapping machine to that shown in Box 1 of FIG. 20, which differs in that it includes a fan or blower 306 to blow air into the product package prior to the presentation seal being formed, to assist in the capturing of air in the product package. It will be appreciated that the region of packaging between neighboring products (shown aligned with the sealing mechanism 305 in FIGS. 20 and 21) will be empty and the package layers will be separate until the presentation seal is formed. The fan 306 shown in FIG. 21 is configured to blow air towards the product 309 as it is being wrapped by the wrapping machine, and the air will also carry to the product in the leading package 321 prior to formation of the presentation seal. As the heat seal bars 317*a*, 318*a* and respective anvils 317*b*, 318*b* are brought together to form a presentation seal on the trailing end of the leading product package 321 and a final seal on the leading edge of the trailing product package 323, the air from the blower 306 will be captured in the leading product package 321. The other operations of the wrapping machine are as described above with reference to FIG. 20.

FIGS. 22A through 22E show an alternative embodiment sealing apparatus which is configured to form a presentation seal on a product bag, and is suitable for use with the vacuum packaging machines described above in relation to FIGS. 1 to 16. It should be noted that in these figures, the direction of travel of the product through the apparatus is from left to right. The sealing apparatus is generally indicated by reference numeral 500, and includes a conveyor arrangement 501 to move the product bag through the apparatus. The product bag comprises a product 503 in an unsealed bag 505, which is fed along by the conveyor arrangement 501 until its unsealed part 507 is aligned with a sealing mechanism 509 as shown in FIG. 22A. A sensor 511 is configured to detect when the unsealed part 507 of the bag is in the desired position, at which time movement of the conveyor is stopped.

With reference to FIG. 22B, the sealing mechanism 509 is moved downwardly relative to the product package, for example through operation of an electric or hydraulic cylinder and ram 510, to bring a package opening device 512 into contact with the unsealed part 507 of the bag. The package opening device 512 is configured to grasp the upper surface of the unsealed part 507 of the package. In the embodiment shown, the package opening device 512 is a vacuum or suction cup. However, other opening devices could be used, such as a mechanical gripping mechanism.

Once the upper surface of the unsealed part 507 has been grasped by the package opening device 512, the sealing mechanism is lifted to lift the upper surface of the unsealed part 507 of the bag, thereby opening the unsealed part of the bag as shown in FIG. 22C. A fan or blower 513 mounted on the sealing mechanism 509 and directed towards the product package, is operated to blow air into the open end product package.

As shown in FIG. 22D, the fan 513 is then stopped, and the sealing mechanism 509 is moved downwards to bring the upper and lower surfaces of the unsealed part together, and to form a presentation seal on the product package in a similar manner as described above. The top surface of the bag is then released from the bag opening device 512, and the sealing mechanism is lifted and the conveyor operated to move the product away from the sealing assembly as shown in FIG. 22E. The product will then be delivered to a vacuum packaging machine as described above.

Modifications may also be made to the embodiments of FIGS. 21 and 22A through 22E without departing from the scope of the invention.

For example, while the package opening device 512 and fan or blower 513 are shown as being mounted on the sealing mechanism, it will be appreciated that they could be configured to move independently. Further, rather than blowing air into the product package, the blower could be connected to a source of gas if it is desired to maintain a higher purity level within in the product package and minimize contaminants.

The sealing apparatus and method described above with respect to FIGS. 20 to 22A through 22E enable strong seals to be formed in a vacuum packaging machine by maintaining the region of the package to be sealed under tension, which helps lie the package relatively flat against the heat seal bar and anvil in the vacuum chamber and minimizes the formation of creases.

What is claimed is:

1. A vacuum packaging machine comprising a plurality of vacuum chambers each arranged to receive an unsealed product package and operable to perform a vacuum sealing operation on the respective unsealed product package, each vacuum chamber having a longitudinal direction defined by a direction of travel of the respective product package through the chamber, each vacuum chamber having therein a heat seal assembly for forming a heat seal across the respective product package, the heat seal disposed transversely to said longitudinal direction, wherein the vacuum packaging machine comprises a conveyor arrangement configured to load and unload a product package to and from a respective vacuum chamber, the conveyor arrangement comprising an infeed conveyor operable to load a selected vacuum chamber with a product package, wherein the infeed conveyor has a telescoping portion operable to telescope over a portion of the heat seal assembly in a vacuum chamber to load the product package into the vacuum chamber such that an unsealed portion of the product package is located over a portion of the heat seal assembly, and to then retract from the chamber to allow the chamber to close to perform the vacuum sealing operation.

2. A vacuum packaging machine comprising a plurality of vacuum chambers each arranged to receive an unsealed product package and operable to perform a vacuum sealing operation on the respective unsealed product package, each vacuum chamber having a longitudinal direction defined by a direction of travel of the respective product package through the chamber, each vacuum chamber having therein a heat seal assembly for forming a heat seal across the respective product package, the heat seal disposed transversely to said longitudinal direction, wherein each vacuum chamber comprises an internal conveyor moveable in the longitudinal direction of the vacuum chamber to expel the respective product package from the vacuum chamber following the vacuum sealing operation, wherein a portion of the internal conveyor extends under a portion of the heat seal assembly in each vacuum chamber.

3. A vacuum packaging machine comprising a plurality of vacuum chambers each arranged to receive an unsealed product package and operable to perform a vacuum sealing operation on the respective unsealed product package, each vacuum chamber having a longitudinal direction defined by a direction of travel of the respective product package through the chamber, each vacuum chamber having therein a heat seal assembly for forming a heat seal across the respective product package, the heat seal disposed transversely to said longitudinal direction, wherein each vacuum chamber comprises an internal conveyor moveable in the longitudinal direction of the vacuum chamber to expel the respective product package from the vacuum chamber following the vacuum sealing operation, wherein each vacuum chamber includes a vacuum chamber hood and wherein a portion of the internal conveyor in each vacuum chamber extends under the vacuum chamber hood thereof, and wherein the internal conveyor includes a belt having a smooth underside so that the vacuum chamber hood seals over the belt.

4. A vacuum packaging machine comprising a plurality of vacuum chambers each arranged to receive an unsealed product package and operable to perform a vacuum sealing operation on the respective unsealed product package, each vacuum chamber having a longitudinal direction defined by a direction of travel of the respective product package through the chamber, each vacuum chamber having therein a heat seal assembly for forming a heat seal across the respective product package, the heat seal disposed transversely to said longitudinal direction, wherein each vacuum chamber comprises an internal conveyor moveable in the longitudinal direction of the vacuum chamber to expel the respective product package from the vacuum chamber following the vacuum sealing operation, wherein at least a portion of the heat seal assembly is retractable to enable a product package to be moved past the heat seal assembly on the internal conveyor, and a telescoping conveyor is substantially vertically aligned with the internal chamber conveyor in a product package loading configuration.

5. A vacuum packaging machine comprising a plurality of vacuum chambers each arranged to receive an unsealed product package and operable to perform a vacuum sealing operation on the respective unsealed product package, each vacuum chamber having a longitudinal direction defined by a direction of travel of the respective product package through the chamber, each vacuum chamber having therein a heat seal assembly for forming a heat seal across the respective product package, the heat seal disposed transversely to said longitudinal direaction, wherein the vacuum packaging machine comprises a puncturing device operable to puncture an aperture in the product package adjacent the heat seal assembly, so that as each vacuum sealing operation occurs, air is forced out of the package through the punctured aperture prior to heat sealing.

6. The vacuum packaging machine of claim 5 comprising a cutting device operable to cut the product package between the heat seal assembly and the puncturing device following each vacuum sealing operation.

7. A vacuum packaging machine comprising a plurality of vacuum chambers each arranged to receive an unsealed product package and operable to perform a vacuum sealing operation on the respective unsealed product package, each vacuum chamber having a longitudinal direction defined by a direction of travel of the respective product package through the chamber, each vacuum chamber having therein a heat seal assembly for forming a heat seal across the respective product package, the heat seal disposed transversely to said longitudinal direaction, wherein a transverse heat seal assembly is located in a longitudinal position in each vacuum chamber such that there is sufficient spacing between end walls of the vacuum chamber and each heat seal assembly for a product package containing two products to be loaded into the vacuum chamber with one product located in front of the heat seal assembly and the other product located behind the heat seal assembly, the heat seal assembly arranged to seal and cut across the product package between two products to form two separate evacuated packages.

8. A vacuum packaging machine comprising a plurality of vacuum chambers each arranged to receive an unsealed product package and operable to perform a vacuum sealing operation on the respective unsealed product package, each vacuum chamber having a longitudinal direction defined by a direction of travel of the respective product package through the chamber, each vacuum chamber having therein a heat seal assembly for forming a heat seal across the respective product package, the heat seal disposed transversely to said longitudinal direaction, the vacuum packaging machine comprising a sealing mechanism adapted to form a temporary seal on part of each product package prior to loading into the vacuum packaging machine to assist in positioning that part of the product package in relation to the heat seal assembly during loading of the product package into the vacuum packaging machine, and maintain that part of the product package under some tension, the vacuum packaging machine configured to evacuate the product package and form a permanent seal in the product package.

9. The vacuum packaging machine of claim 8 wherein the sealing mechanism is configured to form the temporary seal on one part of each product package and the permanent seal on another part of each product package.

10. The vacuum packaging machine of claim 8 wherein the sealing mechanism includes a cutting device for separating adjacent packages between the temporary seal and the permanent seal.

11. The vacuum packaging machine of claim 8 wherein the sealing mechanism is configured to capture air in the product package as the presentation temporary seal is formed.

* * * * *

UNITED STATES PATENT AND TRADEMARK OFFICE

CERTIFICATE OF CORRECTION

PATENT NO. : 7,296,390 B2
APPLICATION NO. : 10/504506
DATED : November 20, 2007
INVENTOR(S) : Koke et al.

It is certified that error appears in the above-identified patent and that said Letters Patent is hereby corrected as shown below:

Column 24, Line 1, “direaction” should be --direction--
Column 24, Line 20, “direaction” should be --direction--
Column 24, Line 41, “direaction” should be --direction--
Column 24, Line 61, “presentation temporary seal” should be --temporary seal--

Signed and Sealed this

Fifteenth Day of April, 2008

JON W. DUDAS
*Director of the United States Patent and Trademark Office*